US006345246B1

(12) United States Patent
Moriya et al.

(10) Patent No.: US 6,345,246 B1
(45) Date of Patent: Feb. 5, 2002

(54) APPARATUS AND METHOD FOR EFFICIENTLY CODING PLURAL CHANNELS OF AN ACOUSTIC SIGNAL AT LOW BIT RATES

(75) Inventors: Takehiro Moriya; Takeshi Mori; Kazunaga Ikeda; Naoki Iwakami, all of Tokyo (JP)

(73) Assignee: Nippon Telegraph and Telephone Corporation, Tokyo (JP)

( * ) Notice: Subject to any disclaimer, the term of this patent is extended or adjusted under 35 U.S.C. 154(b) by 0 days.

(21) Appl. No.: 09/018,042

(22) Filed: Feb. 3, 1998

(30) Foreign Application Priority Data

Feb. 5, 1997 (JP) ..... 9-022339
Jul. 18, 1997 (JP) ..... 9-194204

(51) Int. Cl.[7] ..... G10L 19/04
(52) U.S. Cl. ..... 704/219; 704/500
(58) Field of Search ..... 704/500–504, 704/219

(56) References Cited

U.S. PATENT DOCUMENTS 4,039,948 A 8/1977 Boxall
4,521,907 A * 6/1985 Amir et al. ..... 381/47
4,885,790 A * 12/1989 McAulay et al. ..... 381/36
4,903,301 A * 2/1990 Kondo et al. ..... 704/229
5,307,441 A * 4/1994 Tzeng ..... 395/2.31
5,327,520 A * 7/1994 Chen ..... 395/2.28
5,651,090 A * 7/1997 Moriya et al. ..... 395/2.31
5,673,291 A * 9/1997 Dent ..... 395/262
5,706,392 A * 1/1998 Goldberg et al. ..... 395/2.19
5,774,837 A * 6/1998 Yeldener et al. ..... 704/208
5,799,272 A * 8/1998 Zhu ..... 704/223
5,864,800 A * 1/1999 Imai et al. ..... 704/229
6,167,192 A * 12/2000 Heo ..... 386/124

FOREIGN PATENT DOCUMENTS

EP 0 684 705 11/1995
EP 0 730 365 9/1996
JP 06332499 A 12/1994 ..... G10L/9/18
JP 07092999 A 4/1995 ..... G10L/9/14
JP 08044399 A 2/1996 ..... G10L/9/14

OTHER PUBLICATIONS

Cambridge, P., and Todd, M., "Audio Data Compression Techniques," American Engineering Society Convention, Mar. 16, 1993, No. 94, pp. 1–26.

Iwakami, N., et al., "High–Quality Audio–Coding at Less than 64 KBIT/S by using Transform–Domain Weighted Interleave Vector Quantization (TWINVQ)," IEEE International Conference on Acoustics, Speech, and Signal Processing, vol. 5, May 9–12, 1995, pp. 3095–3098.

* cited by examiner

*Primary Examiner*—Fan Tsang
*Assistant Examiner*—Michael N. Opsasnick
(74) *Attorney, Agent, or Firm*—Connolly Bove Lodge & Hutz LLP

(57) ABSTRACT

In multichannel acoustic signal coding and decoding, left- and right-channel signals are alternately interleaved for each sample to generate a one-dimensional signal sample sequence. The one-dimensional signal sample sequence is subjected to coding based on correlation. In coding, the left- and right-channel signals may preferably be interleaved after reducing an imbalance in power between input channels. In such an instance, a power imbalance is introduced between the decoded left- and right-channel signal sample sequences

74 Claims, 13 Drawing Sheets

FIG.13

BALANCING FACTORS

| CODE | $k = W_L / W_R$ | $g \times W_R$ OR $1/g \times W_L$ |
|---|---|---|
| 000 | $4.0 \leqq k$ | $2.5 \times W_R$ |
| 001 | $2.5 \leqq k < 4.0$ | $1.7 \times W_R$ |
| 110 | $1.5 \leqq k < 2.5$ | $1.4 \times W_R$ |
| 111 | $1.0 \leqq k < 1.5$ | $1.1 \times W_R$ |
| 100 | $1.0 \leqq 1/k < 1.5$ | $1.1 \times W_L$ |
| 101 | $1.5 \leqq 1/k < 2.5$ | $1.4 \times W_L$ |
| 110 | $2.5 \leqq 1/k < 4.0$ | $1.7 \times W_L$ |
| 111 | $4.0 \leqq 1/k$ | $2.5 \times W_L$ |

APPARATUS AND METHOD FOR EFFICIENTLY CODING PLURAL CHANNELS OF AN ACOUSTIC SIGNAL AT LOW BIT RATES

BACKGROUND OF THE INVENTION

The present invention relates to a coding method that permits efficient coding of plural channels of an acoustic signal, such as speech or music, and is particularly suitable for its transmission at low bit rates, a method for decoding such a coded signal and encoder and decoder using the coding and decoding methods, respectively.

It is well-known in the art to quantize a speech, music or similar acoustic signal in the frequency domain with a view to reducing the number of bits for coding the signal. The transformation from the time to frequency domain is usually performed by DFT (Discrete Fourier Transform), DCT (Discrete Cosine Transform) and MDCT (Modified Discrete Cosine Transform) that is a kind of Lapped Orthogonal Transform (LOT). It is also well-known that a linear predictive coding (LPC) analysis is effective in flattening frequency-domain coefficients (i.e. spectrum samples) prior to the quantization. As an example of a method for high-quality coding of a wide variety of acoustic signals through the combined use of these techniques, there are disclosed acoustic signal transform coding and decoding methods, for example, in Japanese Patent Application Laid-Open Gazette No. 44399/96 (corresponding U.S. Pat. No. 5,684,920). In FIG. 1 there is depicted in a simplified form the configuration of a coding device that utilizes the disclosed method.

In FIG. 1, an acoustic signal from an input terminal 11 is applied to an orthogonal transform part 12, wherein it is transformed to coefficients in the frequency domain through the use of the above-mentioned scheme. The frequency-domain coefficients will hereinafter be referred to as spectrum samples. The input acoustic signal also undergoes linear predictive coding (LPC) analysis in a spectral envelope estimating part 13. By this, the spectral envelope of the input acoustic signal is detected. That is, in the orthogonal transform part 12 the acoustic digital signal from the input terminal 11 is transformed to spectrum sample values through Nth-order lapped orthogonal transform (MDCT, for instance) by extracting an input sequence of the past 2N samples from the acoustic signal every N samples. In an LPC analysis part 13A of a spectral envelope estimating part 13, too, a sequence of 2N samples are similarly extracted from the input acoustic digital signal every N samples. From the thus extracted samples d are derived Pth-order predictive coefficients $\alpha_0, \ldots, \alpha_P$. These predictive coefficients $\alpha_0, \ldots, \alpha_P$ are transformed, for example, to LSP parameters or k parameters and then quantized in a quantization part 13B, by which is obtained an index $In_1$ indicating the spectral envelope of the predictive coefficients. In an LPC spectrum calculating part 13C the spectral envelope of the input signal is calculated from the quantized predictive coefficients. The spectral envelope thus obtained is provided to a spectrum flattening or normalizing part 14 and a weighting factor calculating part 15D.

In the spectrum normalizing part 14 the spectrum sample values from the orthogonal transform part 12 are each divided by the corresponding sample of the spectral envelope from the spectral envelope estimating part 13 (flattening or normalization), by which spectrum residual coefficients are provided. A residual-coefficient envelope estimating part 15A further calculates a spectral residual-coefficient envelope of the spectrum residual coefficients and provides it to a residual-coefficient flattening or normalizing part 15B and the weighting factor calculating part 15D. At the same time, the residual-coefficient envelope estimating part 15A calculates and outputs a vector quantization index $In_2$ of the spectrum residual-coefficient envelope. In the residual-coefficient normalizing part 15B the spectrum residual coefficients from the spectrum normalizing part 14 are divided by the spectral residual-coefficient envelope to obtain spectral fine structure coefficients, which are provided to a weighted vector quantization part 15C. In the weighting factor calculating part 15D the spectral residual-coefficient envelope from the residual-coefficient envelope estimating part 15A and the LPC spectral envelope from the spectral envelope estimating part 13 are multiplied for each corresponding spectrum sample to obtain weighting factors $W=w_1, \ldots, w_N$, which are provided to the weighted vector quantization part 15C. It is also possible to use, as the weighting factors W, coefficients obtained by multiplying the multiplied results by psychoacoustic or perceptual coefficients based on psychoacoustic or perceptual models. In the weighted vector quantization part 15C the weighted factors W are used to perform weighted vector quantization of the fine structure coefficients from the residual coefficient normalizing part 15B. And the weighted vector quantization part 15C outputs an index $In_3$ of this weighted vector quantization. A set of thus obtained indexes $In_1$, $In_2$ and $In_3$ is provided as the result of coding of one frame of the input acoustic signal At the decoding side depicted in FIG. 1B, the spectral fine structure coefficients are decoded from the index $In_3$ in a vector quantization decoding part 21A. In decoding parts 22 and 21B the LPC spectral envelope and the spectral residual-coefficient envelope are decoded from the indexes $In_1$ and $In_2$, respectively. A residual coefficient de-flattening or de-normalizing (inverse flattening or inverse normalizing) part 21C multiplies the spectral residual coefficient envelope and the spectral fine structure coefficients for each corresponding spectrum sample to restore the spectral residual coefficients. A spectrum de-flattening or de-normalizing (inverse flattening or inverse normalizing) part 25 multiplies the thus restored spectrum residual coefficients by the decoded LPC spectral envelope to restore the spectrum sample values of the acoustic signal. In an orthogonal inverse transform part 26 the spectrum sample values undergo orthogonal inverse transform into time-domain signals, which are provided as decoded acoustic signals of one frame at a terminal 27.

In the case of coding input signals of plural channels through the use of such coding and decoding methods described in the afore-mentioned Japanese patent application laid-open gazette, the input signal of each channel is coded into the set of indexes $In_1$, $In_2$ and $In_3$ as referred to above. It is possible to reduce combined distortion by controlling the bit allocation for coding in accordance with unbalanced power distribution among channels. In the case of stereo signals, there has already come into use, under the name of MS stereo, a scheme that utilizes the imbalance in power between right and left signals by transforming them into sum and difference signals.

The MS stereo scheme is effective when the right and left signals are closely analogous to each other, but it does not sufficiently reduce the quantization distortion when they are out of phase with each other. Thus the conventional method cannot adaptively utilize correlation characteristics of the right and left signals. Furthermore, there has not been proposed an idea of multichannel signal coding through utilization of the correlation between multichannel signals when they are unrelated to each other.

SUMMARY OF THE INVENTION

It is therefore an object of the present invention to provide a coding method that provides improved signal quality through reduction of the quantization distortion in the coding of multichannel input signals such as stereo signals, a decoding method therefor and coding and decoding devices using the methods.

The multichannel acoustic signal coding method according to the present invention comprises the steps of:

(a) interleaving acoustic signal sample sequences of plural channels under certain rules into a one-dimensional signal sequence; and (b) coding the one-dimensional signal sequence through utilization of the correlation between the acoustic signal samples and outputting the code.

In the above coding method, step (a) may also be preceded by the steps of:

(0-1) calculating the power of the acoustic signal sample sequence of each channel for each certain time duration; and (0-2) decreasing the difference in power between the input acoustic signal sample sequences of the plural channels on the basis of the calculated power for each channel and using the plural acoustic signal sample sequences with their power difference decreased, as the acoustic signal sample sequences of the above-mentioned plural channels.

The decoding method according to the present invention comprises the steps of:

(a) decoding, as a one-dimensional signal sample sequence, an input code sequence by the decoding method corresponding to the coding method that utilizes the correlation between samples; and (b) distributing the decoded one-dimensional signal sample sequence to plural channels by reversing the procedure of the above-mentioned certain rules to obtain acoustic sample sequences of the plural channels.

In the above decoding method, the acoustic signal sample sequences of the plural channels may also be corrected, prior to their decoding, to increase the power difference between them through the use of a balancing actor obtained by decoding an input power correction index.

The multichannel acoustic signal coding device according to the present invention comprises:

interleave means for interleaving acoustic signal sample sequences of plural channels under certain rules into a one-dimensional signal sample sequence; and coding means for coding the one-dimensional signal sample sequence through utilization of the correlation between samples and outputting the code.

The above coding device may further comprise, at the stage preceding the Interleave means: power calculating means for calculating the power of the acoustic signal sample sequence of each channel for each fixed time interval; power deciding means for determining the correction of the power of each of the input acoustic signal sample sequences of the plural channels to decrease the difference in power between them on the basis of the calculated values of power; and power correction means provided in each channel for correcting the power of its input acoustic signal sample sequence on the basis of the power balancing factor.

The decoding device according to the present invention comprises:

decoding means for decoding an input code sequence into a one-dimensional signal sample sequence by the decoding method corresponding to the coding method that utilizes the correlation between samples; and inverse interleave means for distributing the decoded one-dimensional signal sample sequence to plural channels by reversing the procedure of the above-mentioned certain rules to obtain acoustic signal sample sequences of the plural channels.

The above decoding device may further comprises: power index decoding means for decoding an input power correction index to obtain a balancing factor; and power inversely correcting means for correcting the acoustic signal sample sequences of the plural channels through the use of the balancing factor to increase the difference in power between them.

BRIEF DESCRIPTION OF THE DRAWINGS

FIG. 13 is a table showing examples of balancing factors;

DESCRIPTION OF THE PREFERRED EMBODIMENTS

Figure 2A:
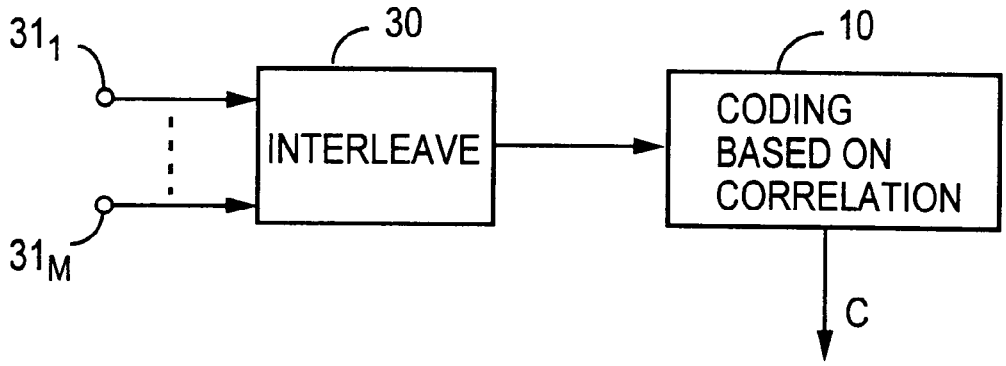
FIG. 2A is a block diagram showing the principle of the coding device according to the present invention.
Figure 2B:
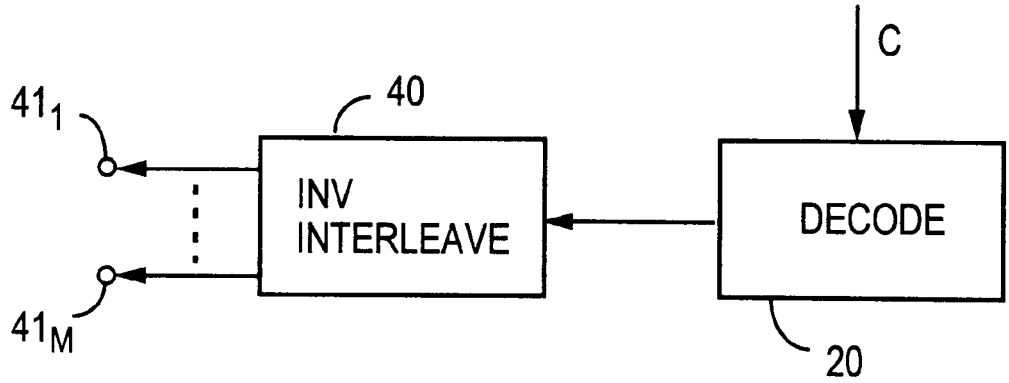
FIG. 2B is a block diagram showing the decoding device corresponding to the coding device of FIG. 2A.

FIG. 2A illustrates in block form the basic construction of the coding device based on the principle of the present invention. FIG. 2B illustrates also in block form the basic construction of the decoding device that decodes a code C output from the coding device. As depicted in FIG. 2A, according to the principle of the coding scheme of the present invention, input signal samples of M channels (i.e. multi-dimensional) applied to M (where M is an integer equal to or greater than 2) terminals $\mathbf{31}_1$ through $\mathbf{31}_M$ are interleaved by an interleave part 30 in a sequential order into one sequence (i.e., one dimensional) of signal samples. A coding part 10 codes the one sequence of signal samples by a coding method that utilizes the correlation between the signals of the M channels and then outputs the code C. The coding part 10 needs only to use the coding scheme that utilizes the correlation between signals as mentioned above. Accordingly, the coding scheme of the coding part 10 may be one that codes signals in the time domain or in the frequency domain, or a combination thereof. What is important is to interleave signal samples of M channels into a sequence of signal samples and code them through utilization of the correlation of the signals between the M channels. One possible coding method that utilizes the correlation between signals is a method that uses LPC techniques. The LPC scheme makes signal predictions based primarily on the correlation between signals; hence, this scheme is applicable to the coding method of the present invention. As a coding scheme that utilizes the correlation between signals in the time domain, it is possible to employ, for example, an ADPCM (Adaptive Differential Pulse Code Modulation) or CELP (Code-Excited Linear Prediction coding) method.

In FIG. 2B there is shown a device for decoding the code coded by the coding device of FIG. 2A. The decoding device decodes the code C, fed thereto, into a one-dimensional sample sequence by a procedure reverse to that for coding in the coding part 10 in FIG. 2A. The thus decoded sample sequence is provided to an inverse interleave part 40. The inverse interleave part 40 distributes the samples of the one sequence to M channel output terminals $\mathbf{41}_1$ through $\mathbf{41}_M$ by a procedure reverse to that used for interleaving in the interleave part 30 in FIG. 2A. As a result, signal sample sequences of the M channels are provided at the output terminals $\mathbf{41}_1$ through $\mathbf{41}_M$.

Next, a description will be given of concrete examples of the coding and decoding devices based on the principles of the present invention, depicted in FIGS. 2A and 2B, respectively. For the sake of brevity, the coding and decoding devices will be described to have two right and left input stereo channels, but more than two input channels may also be used.

Figure 1A:
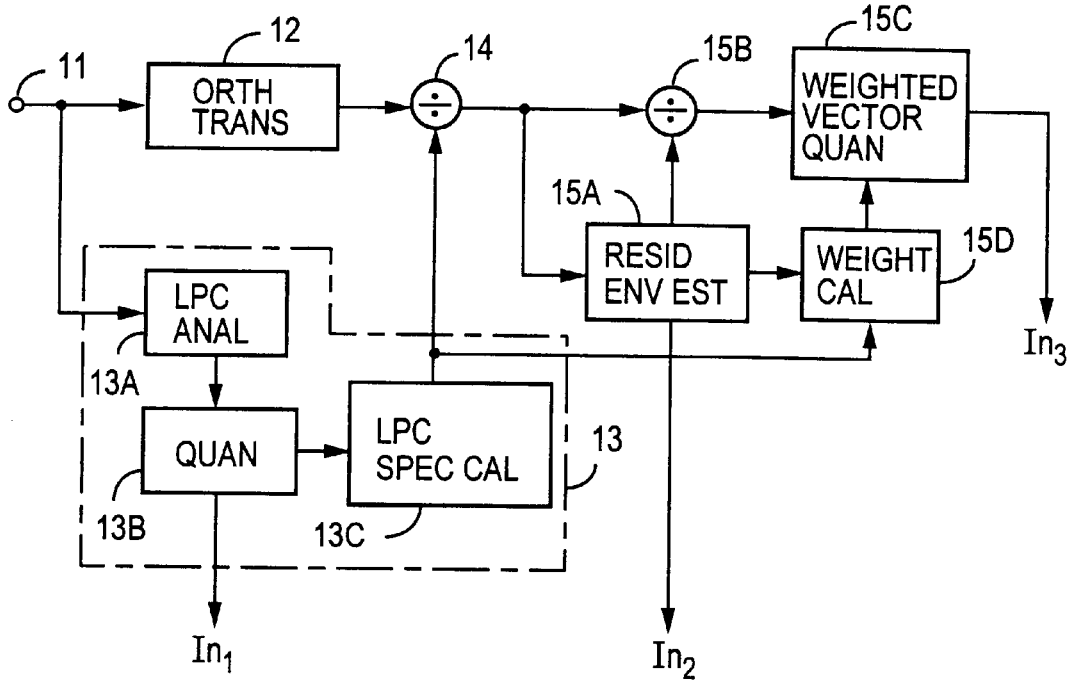
FIG.1A PRIOR ART
FIG. 1A is a block diagram depicting a conventional coding device.
Figure 3A:
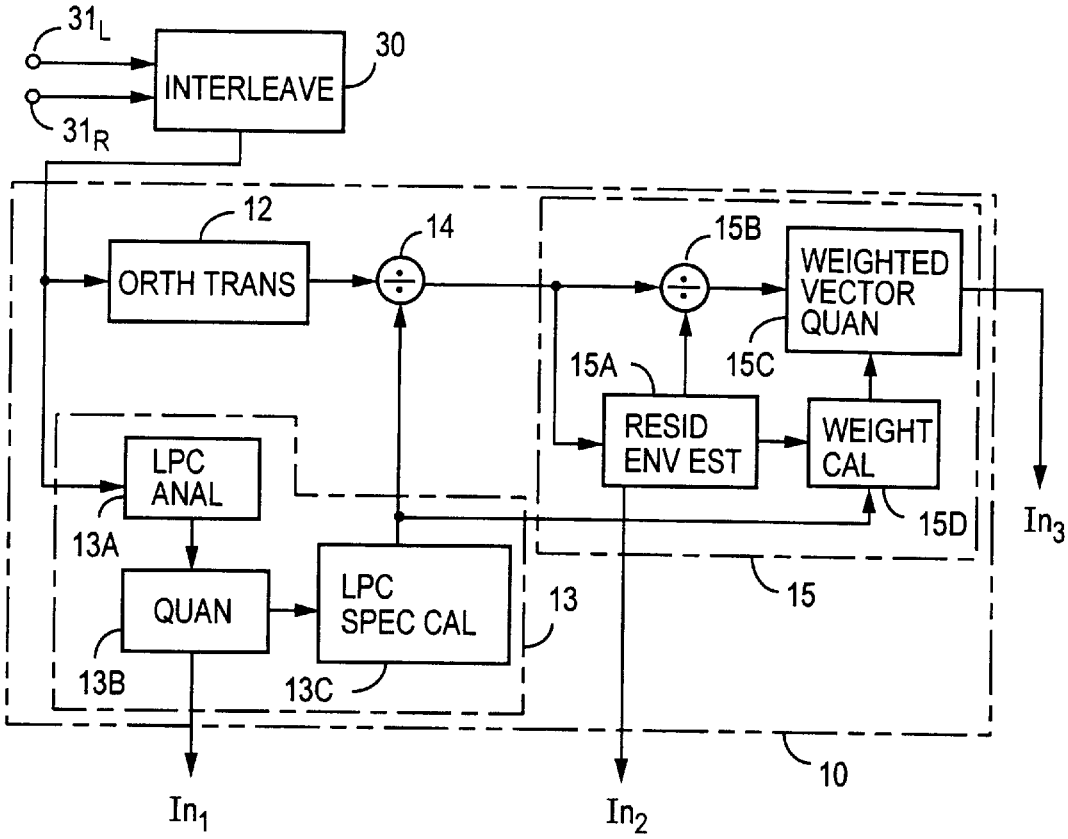
FIG. 3A is a block diagram illustrating a concrete embodiment of the coding device according to the present invention.

FIG. 3A illustrates an embodiment in which the coding part 10 performs transform coding in the frequency domain. The coding part 10 comprises an orthogonal transform part 12, a spectral envelope estimating part 13, a spectrum normalizing part 14 and a spectrum residual-coefficient coding part 15. The spectral envelope estimating part 13 is composed of the LPC analysis part 13A, the quantization part 13B and the LPC spectral envelope calculating part 13C as is the case with the prior art example of FIG. 1A. The spectrum residual-coefficient coding part 15 is also composed of the residual-coefficient envelope estimating part 15A, the residual coefficient normalizing part 15B, the weighted vector quantization part 15C and the weighting factor calculating part 15D as in the case of the prior art example of FIG. 1. That is, the coding part 10 of FIG. 3 has exactly the same configuration as that of the conventional coding device depicted in FIG. 1A.

The FIG. 3A embodiment uses left- and right-channel stereo signals as multichannel acoustic signals. Left-channel signal sample sequences and right-channel signal sample sequences are applied to input terminals $\mathbf{31}_L$ and $\mathbf{31}_R$ of the interleave part 30, respectively The left- and right-channel signal sample sequences are interleaved under certain rules into a one-dimensional time sequence of signal samples.

Figure 3B:
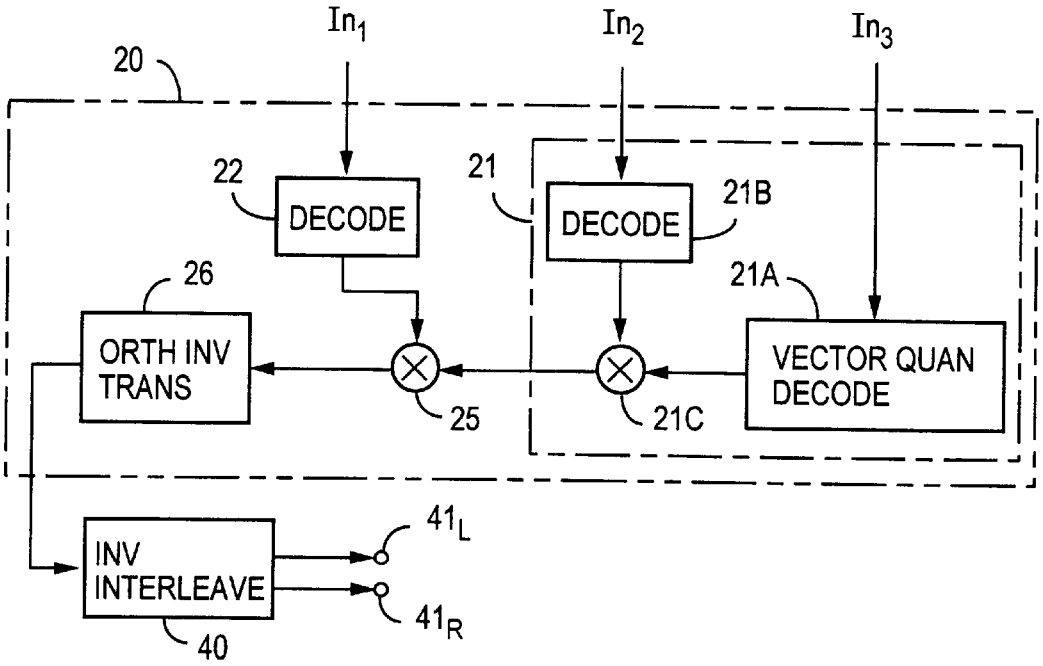
FIG. 3B is a block diagram illustrating a concrete embodiment of the decoding device corresponding to the coding device of FIG. 3A.
Figure 4:
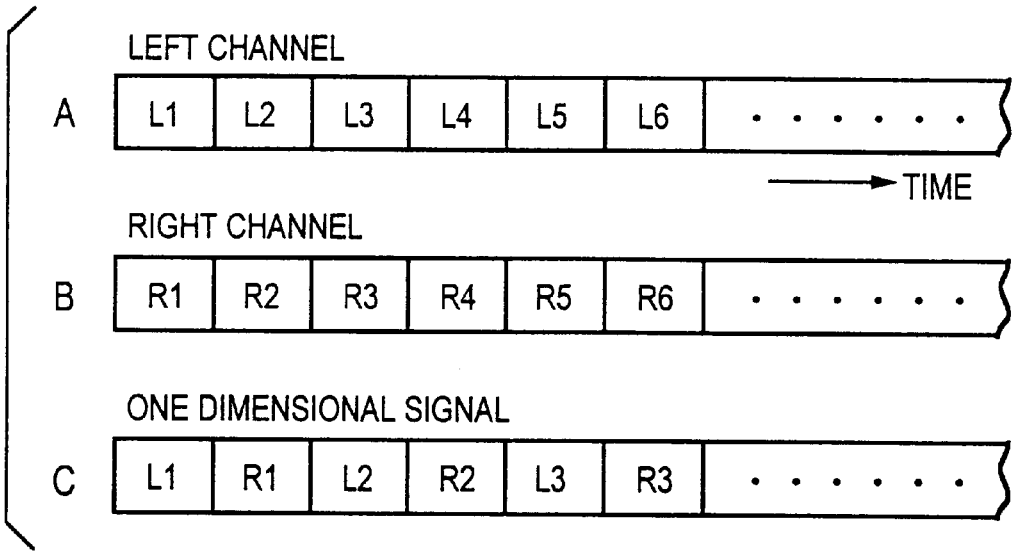
FIG. 4 is a diagram for explaining how to interleave signal samples of two channels.

For example, right-channel signal sample sequences L1, L2, L3, . . . and right-channel signal sample sequences R1, R2, R3, . . . , depicted on Rows A and B in FIG. 4, respectively, are interleaved into such a sequence of signals as shown on Row C in FIG. 3 in which sample values of the left- and right-channel signals are alternately interleaved in time sequence. In this way, the stereo signal is synthesized as a one-dimensional signal in such a common format as used for data interleaving on an electronic computer.

In the present Invention this artificially synthesized one-dimensional signal sample sequence is coded intact as described below. This can be done using the same scheme as that of the conventional coding method. In this instance, however, it is possible employ the transform coding method, the LPC method and any other coding methods as long as they transform input samples into frequency-domain coefficients or LPC coefficients (the LPC coefficients are also parameters representing the spectral envelope) for each frame and perform vector coding of them so as to minimize distortion.

In the FIG. 3A embodiment, as is the case with the prior art, the orthogonal transform part 12 repeatedly extracts a contiguous sequence of 2N samples from the input signal sample sequence at N-sample intervals and derives frequency-domain coefficients of N samples from each sequence of 2N samples by MDCT, for instance. And the thus obtained frequency-domain coefficients are quantized. On the other hand, the LPC analysis part 13A of the spectral envelope estimating part 13 similarly extracts a 2N-sample sequence from the input acoustic digital signal every N samples and, as is the case with the prior art example of FIG. 1A, calculates the Pth-order predictive coefficients $\alpha_0, \ldots, \alpha_P$ from the extracted samples. These predictive coefficients $\alpha_0, \ldots, \alpha_P$ are provided to the quantization part 13B, wherein they are transformed, for example, to LSP parameters or PARCOR coefficients and then quantized to obtain the index $In_1$ representing the spectral envelope of the predictive coefficients. Furthermore, the LPC spectral envelope calculating part 13C calculates the spectral envelope from the quantized predictive coefficients and provides it to the spectrum normalizing part 14 and the weighting factor calculating part 15D.

In the spectrum normalizing part 14 the spectrum sample values from the orthogonal transform part 12 are each divided by the corresponding sample of the spectral envelope from the spectral envelope estimating part 13. By this, spectrum residual coefficients are obtained. The residual-coefficient envelope estimating part 15A further estimates the spectral envelope of the spectrum residual coefficients and provides it to the residual coefficient normalizing part 15B and the weighting factor calculating part 15D. At the same time, the residual-coefficient envelope estimating part 15A calculates and outputs the vector quantization index $In_2$ of the spectral envelope. In the residual coefficient normalizing part 15B the spectrum residual coefficients fed thereto from the spectrum normalizing part 14 are divided by the spectrum residual-coefficient envelope to provide spectral fine structure coefficients, which are fed to the weighted vector quantization part 15C. In the weighting factor calculating part 15D the spectral residual-coefficient envelope from the residual-coefficient envelope estimating part 5A and the LPC spectral envelope from the spectral envelope estimating part 13 are multiplied for each corresponding spectral sample to make a perceptual correction. As a result, the weighting factor $W=w_1, \ldots, w_N$ is obtained, which are provided to the weighted vector quantization part 15C. It is also possible to use, as the weighting factor W, a value obtained by multiplying the above multiplied value by a psychoacoustic or perceptual coefficients based on psychoacoustic models. The weighted vector quantization part 15C uses the weighting factor W to perform weighted vector quantization of the fine structure coefficients from the residual coefficient normalizing part 15B and outputs the index $In_3$. The set of indexes In1, In2 and In3 thus calculated is output as the result of coding of one frame of the input acoustic signal.

Figure 5A:
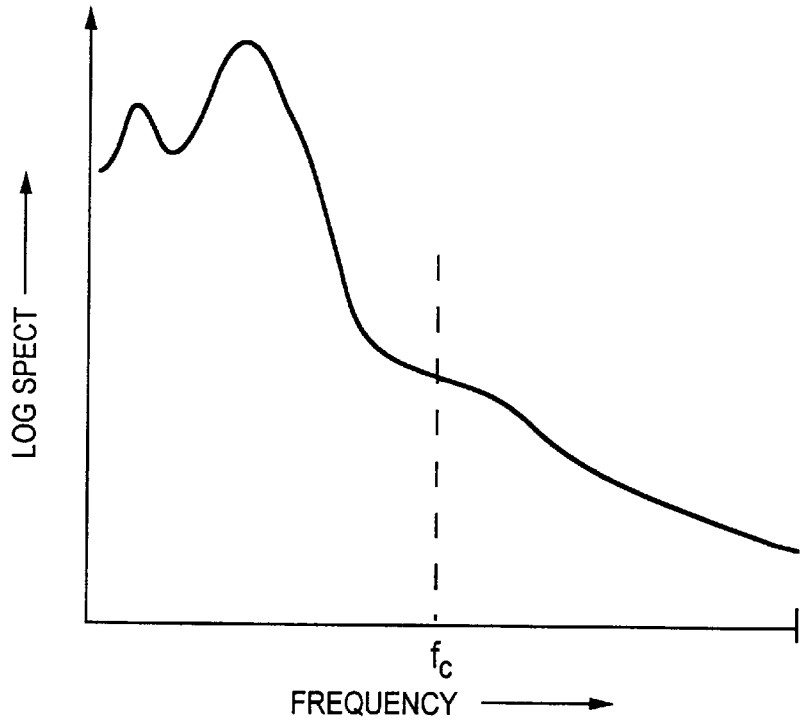
FIG. 5A is a graph showing an example of the spectrum of a signal of one sequence into which two-channel signals of about the same levels were interleaved.

As described above, in this embodiment the left- and right-channel signals are input into the coding part 10 while being alternately interleaved for each sample, and consequently, LPC analysis or MDCT of such an interleaved input signal produces an effect different from that of ordinary one-channel signal processing. That is, the linear prediction in the LPC analysis part 13A of this embodiment uses past or previous samples of the right and left channels to predict one sample of the right channel, for instance. Accordingly, for example, when the left- and right channel signals are substantially equal in level, the resulting spectral envelope is the same as in the case of a one-dimensional acoustic signal as depicted in FIG. 5A. Since this LPC analysis uses the correlation between the channels, too, the prediction gain (original signal energy/spectrum residual signal energy) is larger than in the case of the one-dimensional signal. In other words, the distortion removing effect by the transform coding is large.

Figure 5B:
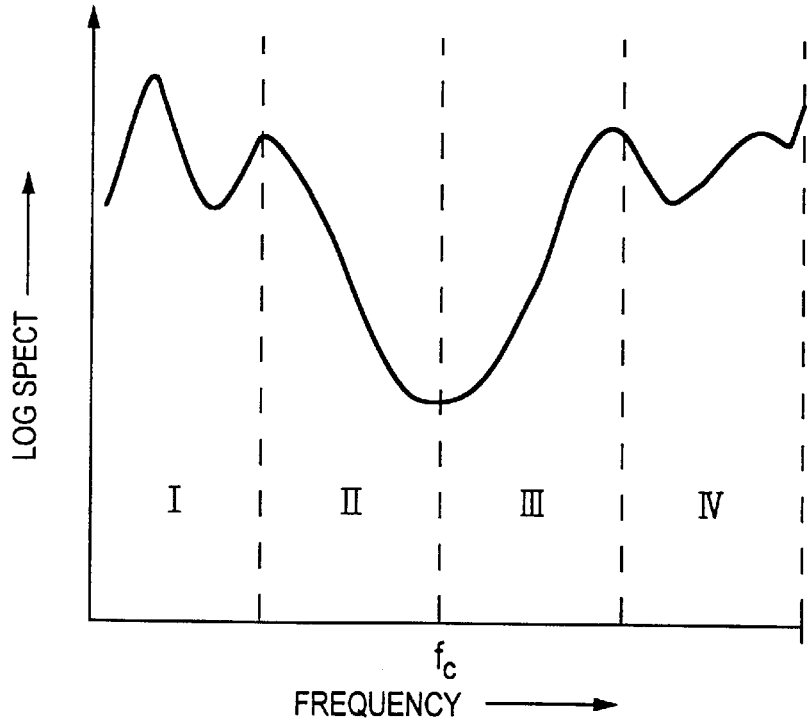
FIG. 5B is a graph showing an example of the spectrum of a signal of one sequence into which two-channel signals of largely different levels were interleaved.

When the left- and right channel signals largely differ in level, the spectral envelope frequently becomes almost symmetrical with respect to the center frequency $f_c$ of the entire band as depicted in FIG. 5B. In this instance, the component higher than the center frequency $f_c$ is attributable to the difference between the left- and right-channel signals, whereas the component lower than the center frequency $f_c$ is attributable to the sum of the both signals. When the left- and right-channel signal levels greatly differ, their correlation is also low. In such a case, too, a prediction gain corresponding to the magnitude of the correlation between the left- and right-channel signals is provided; the present invention produces an effect in this respect as well. Incidentally, it is known mathematically that when either one of the left- and right-channel signals is zero, the spectrum of the one-dimensional signal resulting from the above-mentioned interleave processing takes such a form that low- and high-frequency components are symmetrical with respect to the center frequency $f_c=f_s/4$ where $f_s$ is the sampling frequency In such a case as depicted in FIG. 5B, the sum of the left- and right-channel signals, that is, the sound of only an averaged version of the both signals is reproduced unless the necessary information is sent after forcing the component higher than the center frequency $f_c$ to zero. For example, in the case of adaptive bit allocation to each channel according to the traffic density or in the case of reducing a fixed number of bits or amount of information for each channel so as to increase the number of channels to accommodate increased traffic volume in existing communication facilities, the frequency-domain coefficients of that frequency component of the orthogonally transformed output from the orthogonal transform part 12 which is higher than the center frequency $f_c$ are removed, then only the frequency-domain coefficients of the low-frequency component are divided (flattened) in the spectrum normalizing part 14, and the divided outputs are coded by quantization. The coefficients of the high-frequency component may also be removed after the division in the spectrum normalizing part 14. According to this method, when the amount of information is small, no stereo signal is produced, but distortion can be made relatively small.

The logarithmic spectrum characteristic, which is produced by alternate interleaving of two-channel signals for each sample and the subsequent transformation to frequency-domain coefficients, contains, in ascending order of frequency, a region (I) by the sum $L_L+R_L$ of the low-frequency components of the left- and right channel signals L and R, a region (II) by the sum $L_H+R_H$ of the high-frequency components of the left- and right-channel signals L and R, a region (III) by the difference $L_H-R_H$ between the high-frequency components of the left- and right-channel signals L and R, and a region (IV) based on the difference $L_L-R_L$ between the low-frequency components of the left- and right-channel signals L and R. The entire band components of the left- and right-channel signals can be sent by vector-quantizing the signals of all the regions (I) through (IV) and transmitting the quantized codes. It is also possible, however, to send the vector quantization index $In_3$ of only the required band component along with the predictive coefficient quantization index $In_1$ and the estimated spectral quantization index $In_2$ as described below.

(A) Send respective vector-quantized codes of the four frequency regions (I) to (IV). In this instance, since the entire band signals of the two channels are decoded at the decoding side, a wide-band stereo signal can be decoded.

(B) Send the vector-quantized codes of only the regions (I), (II) and (IV) except the region (III). In this case, the low-frequency component of the decoded output is stereo but the high-frequency component is only the sum component of the left- and right-channel signals.

(C) Send the vector-quantized codes of the regions (I) and (IV) or (II) except the regions (III) and (II) or (IV). In the former case (of sending the regions (I) and (IV)), the decoded output is stereo but the high-frequency component drops. In the latter case (of sending the regions (I) and (II)), the decoded output signal is wide-band but entirely monophonic.

(D) Send the vector-quantized code of only the region (I) except the regions (II), (III) and (IV). In this instance, the decoded output is a monophonic signal composed only of the low-frequency component.

The amount of information necessary for sending the coded signal decreases in alphabetical order of the above-mentioned cases (A) to (D). For example, when traffic is low, a large amount of information can be sent; hence, the vector-quantize d codes of all the regions are sent (A). When the traffic volume is large, the vector-quantized code of the selected one or ones of the regions (I) through (IV) are sent accordingly as mentioned above in (B) to (D). By such vector quantization of the frequency-domain coefficients of the two-channel stereo signals in the four regions, the band or bands to be sent and whether to send the coded outputs in stereo or monophonic form according to the actual traffic volume can be determined independently of individual processing for coding. Of course, the region whose code is sent may be determined regardless of the channel traffic or it may also be selected, depending merely on the acoustic signal quality required at the receiving side (decoding side). Alternatively, the codes of the four regions received at the receiving side may selectively be used as required.

The above has described an embodiment of the coding device from the viewpoint of information compression. By controlling the coefficient of the high-frequency component in the decoding device, the stereophonic effect can be adjusted. For example, the polarity inversion of the coefficients in the frequency range higher than the center frequency $f_c$ means the polarity inversion of the difference component of the left and right signals. In this case, the reproduced sound has the left and right signals reversed. This polarity inversion control may be effected on the coefficients either prior or subsequent to the flattening in the dividing part. This permits control of a sound image localization effect. This control may also be effected on the coefficients either prior or subsequent to the flattening.

Figure 1B:
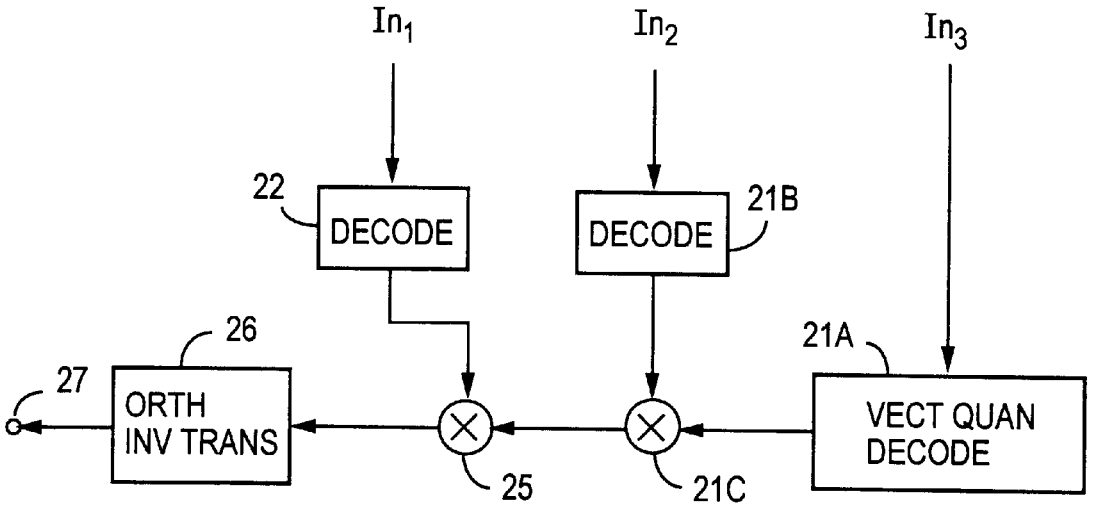
FIG.1B PRIOR ART
FIG. 1B is a block diagram depicting a conventional decoding device.

In FIG. 3B there is shown in block form the decoding device according to the present invention which decodes the code bit train of the indexes $In_1$, $In_2$ and $In_3$ coded as described above with reference to FIG. 3A. The parts corresponding to those in FIG. 1B are identified by the same reference numerals. As in the case of the conventional decoding device of FIG. 1B, the vector-quantization decoding part 21A decodes the index $In_3$ to decode spectrum fine structure coefficients at N points. On the other hand, the decoding parts 22 and 21B restore the LPC spectral envelope and the spectrum residual-coefficient envelope from the indexes $In_1$ and $In_2$, respectively. The residual-coefficient de-normalizing part 21C multiplies (de-flattens) the spectrum residual-coefficient envelope and the spectrum fine structure coefficients for each corresponding spectrum sample, restoring the spectrum residual coefficients. The spectrum de-normalizing part 25 multiplies (de-flattens) the spectrum residual coefficients by the restored LPC spectral envelope to restore the spectrum sample values of the acoustic signal. The spectrum sample values thus restored are transformed into time-domain signal samples at 2N points through orthogonal inverse transform in the orthogonal inverse transform part 26. These samples are overlapped with N samples of preceding and succeeding frames. According to the present invention, the interleave part 40 performs interleaving reverse to that in the interleave part 30 at the coding side. In this example, the decoded samples are alternately fed to output terminals $\mathbf{41}_L$ and $\mathbf{41}_R$ to obtain decoded left- and right channel signals.

In this decoding method, too, the frequency components of the decoded transformed coefficients higher than the center frequency $f_c$ may be removed either prior or subsequent to the de-flattening in the spectrum de-normalizing part 25 so that averaged signals of the left- and right channel signals are provided at the terminals $\mathbf{41}_L$ and $\mathbf{41}_R$. Alternatively, the values of the high-frequency components of the coefficients may be controlled either prior or subsequent to the de-flattening.

Figure 6A:
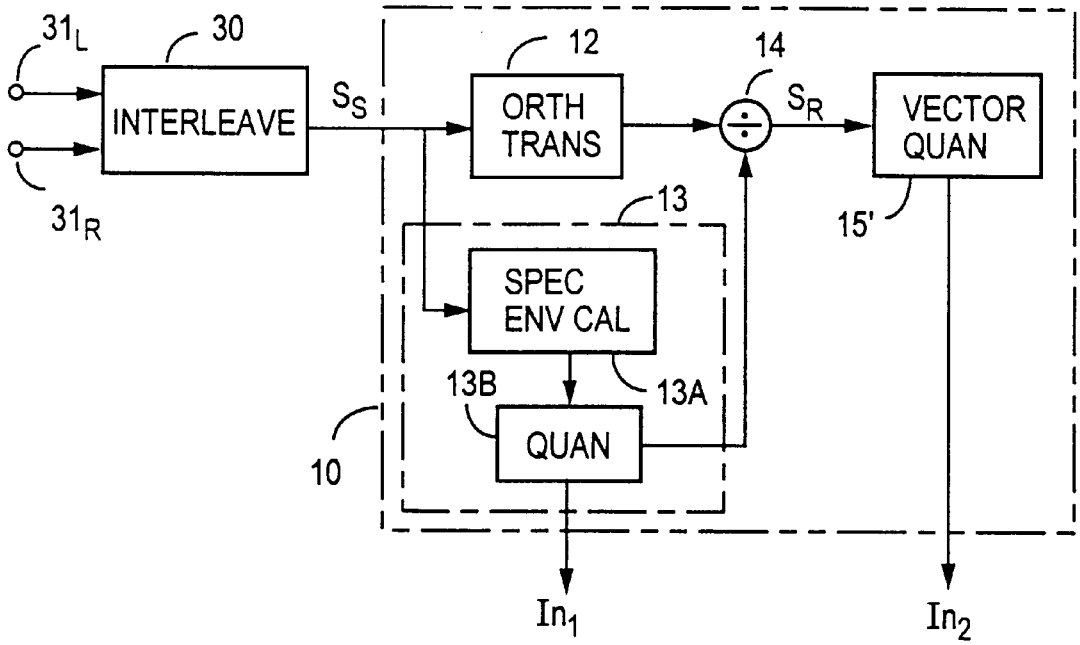
FIG. 6A is a block diagram illustrating an embodiment of a coding device using a transform coding method.
Figure 6B:
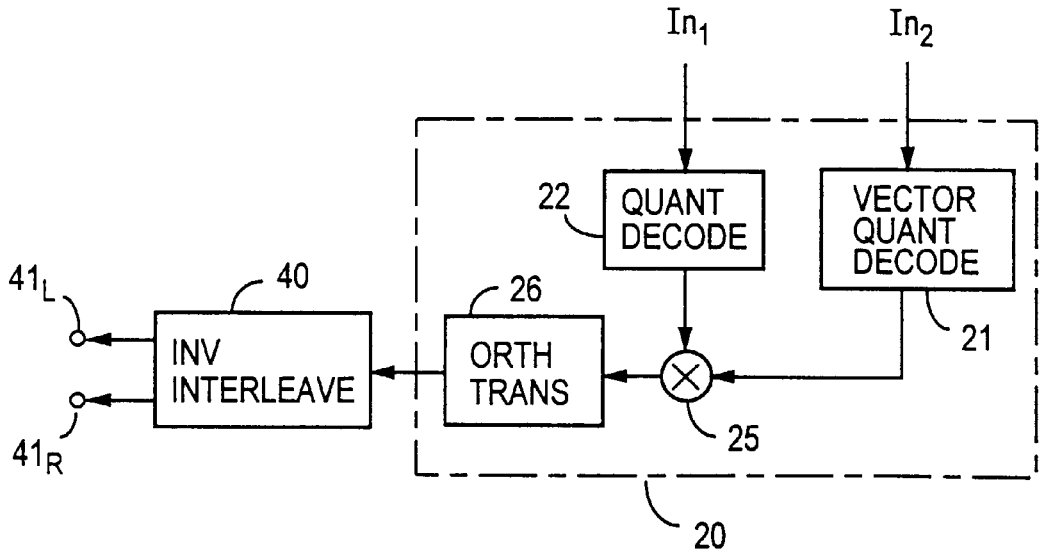
FIG. 6B is a block diagram illustrating the decoding device corresponding to the coding device of FIG. 6A.

In the embodiments of FIGS. 3A and 3B the residual-coefficient envelope estimating part 15A, the residual-coefficient normalizing part 15B, the decoding part 21B and the residual-coefficient de-normalizing part 21C may be left out as depicted in FIGS. 6A and 6B.

The coding device of FIG. 6A also performs transfer coding as is the case with the FIG. 3A embodiment but does not normalize the spectrum residual coefficients in the spectrum residual-coefficient coding part 15; instead the spectrum residue $S_R$ from the spectrum normalizing part 14 is vector-quantized intact in a vector quantization part 15', from which the index $In_2$ is output. This embodiment also estimates the spectral envelope of the sample sequence in the spectral envelope estimating part 13 as is the case with the FIG. 3A embodiment. In general, the spectral envelope of the input signal sample sequence can be obtained by the three methods described below, any of which can be used.

(a) The LPC coefficients $\alpha$ of the input signal sample sequence are Fourier-transformed to obtain the spectral envelope.

(b) The spectrum samples, into which the input signal sample sequence is transformed, are divided into plural bands and the scaling factor in each band is obtained as the spectral envelope.

(c) The LPC coefficients $\alpha$ of a time-domain sample sequence, obtained by inverse transformation of absolute values of spectrum samples obtained by the transformation of the input signal sample sequence, are calculated and the LPC coefficients are Fourier-transformed to obtain the spectral envelope.

The methods (a) and (c) are based on the facts described below. The LPC coefficients $\alpha$ represent the impulse response (or frequency characteristic) of an inverse filter that operates to flatten the frequency characteristic of the input signal sample sequence. Accordingly, the spectral envelope of the LPC coefficients $\alpha$ corresponds to the spectral envelope of the input signal sample sequence. To be precise, the spectral amplitude resulting from Fourier transform of the LPC coefficients $\alpha$ is the inverse of the spectral envelope of the input signal sample sequence.

While the FIG. 3A embodiment has been described to calculate the spectral envelope by the LPC analysis, the FIG. 6A embodiment calculates the spectral envelope in the spectral envelope calculating part 13D through the use of the method (b). The calculated spectral envelope is quantized in the quantization part 13B, from which the corresponding quantization index $In_1$ is output. At the same time, the quantized spectral envelope is provided to the spectrum normalizing part 14 to normalize the frequency-domain coefficients from the orthogonal transform part 12. It is a matter of course that the spectral envelope estimating part 13 in FIG. 6A may be of the same construction as that in the FIG. 3A embodiment.

In the decoding device, as depicted in FIG. 6B, the indexes $In_1$ and $In_2$ are decoded in a decoding part 22 and a vector decoding part 21 to obtain the spectral envelope and the spectrum residue, which are multiplied by each other in the spectrum de-normalizing part 25 to obtain spectrum samples. These spectrum samples are transformed by the orthogonal inverse transform part 26 into a time-domain one-dimensional sample sequence, which is provided to an inverse Interleave part 40. The inverse interleave part 40 distributes the one-dimensional sample sequence to the left and right channels, following a procedure reverse to that in the interleave part 30 in FIG. 6A. As a result, left- and right-channel signals are provided at the terminals $\mathbf{41}_L$ and $\mathbf{41}_R$, respectively.

Figure 7A:
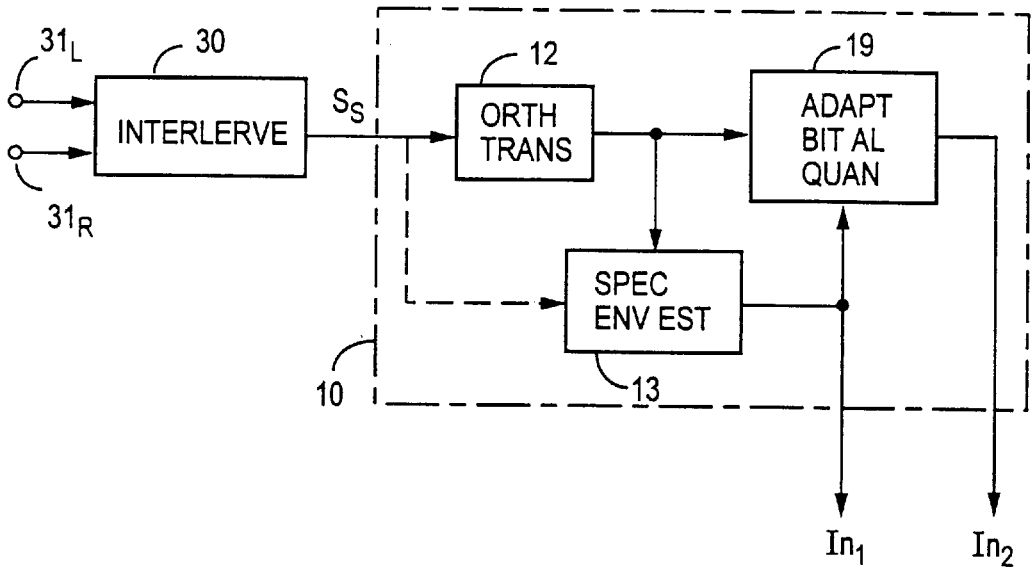
FIG. 7A is a block diagram illustrating another embodiment of the coding device using the transfer coding method.

In an embodiment of FIG. 7A, the spectrum samples transformed from the one-dimensional sample sequence by the orthogonal transform part 12 are not normalized into spectrum residues, but instead the spectrum samples are subjected to adaptive bit allocation quantization in an adaptive bit allocation quantization part 19 on the basis of the spectral envelope obtained in the spectral envelope estimating part 13. The spectral envelope estimating part 13 may be designed to estimate the spectral envelope by dividing each frequency-domain coefficient, provided from the orthogonal transform part 12 as indicated by the solid line, into plural bands by the aforementioned method (b). Alternatively, the spectral envelope estimating part 13 may be adapted to estimate the spectral envelope from the input sample sequence by the afore-mentioned method (a) or (b) as indicated by the broken line.

Figure 7B:
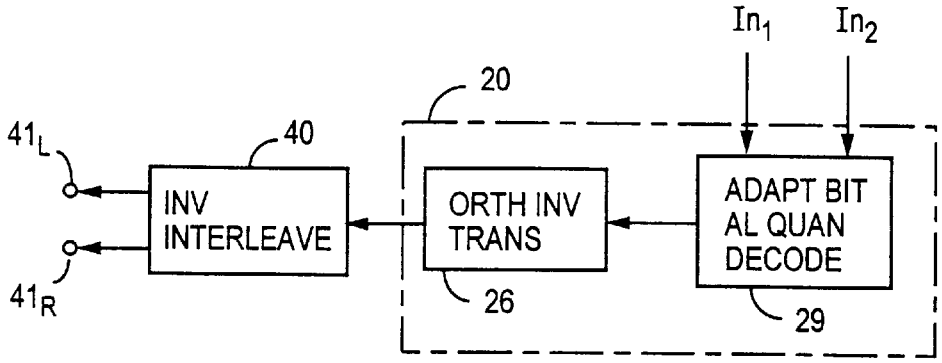
FIG. 7B is a block diagram illustrating the decoding device corresponding to the coding device of FIG. 7A.

The corresponding decoding device comprises, as depicted in FIG. 7B, the inverse interleave part 40 and the decoding part 20. The decoding part 20 is composed of the orthogonal inverse transform part 26 and an adaptive bit allocation decoding part 29. The adaptive bit allocation decoding part 29 uses the bit allocation index $In_1$ and the quantization index In2 from the coding device of FIG. 7A to perform adaptive bit allocation decoding to decode the spectrum samples, which are provided to the orthogonal inverse transform part 26. The orthogonal inverse transform part 26 transforms the spectrum samples into the time-domain sample sequence by orthogonal inverse transform processing. In this embodiment, too, the inverse interleave part 40 processes the sample sequence in reverse order to how the spectrum samples were interleaved in the interleave part 30 of the coding device. As a result, left- and right-channel signal sequences are provided at the terminals $\mathbf{41}_L$ and $\mathbf{41}_R$, respectively.

In the embodiment of the coding device depicted in FIG. 7A, the adaptive bit allocation quantization part 19 may be substituted with a weighted vector quantization part. In this instance, the weighted vector quantization part performs vector-quantization of the frequency-domain coefficients by using, as weighting factors, the spectral envelope provided from the spectral envelope estimating part 13 and outputs the quantization index $In_2$. In the decoding device of FIG. 7B, the adaptive bit allocation decoding part 29 is replaced with a weighted vector quantization part that performs weighted vector quantization of the spectral envelope from the spectral envelope calculating part 24.

Figure 8A:
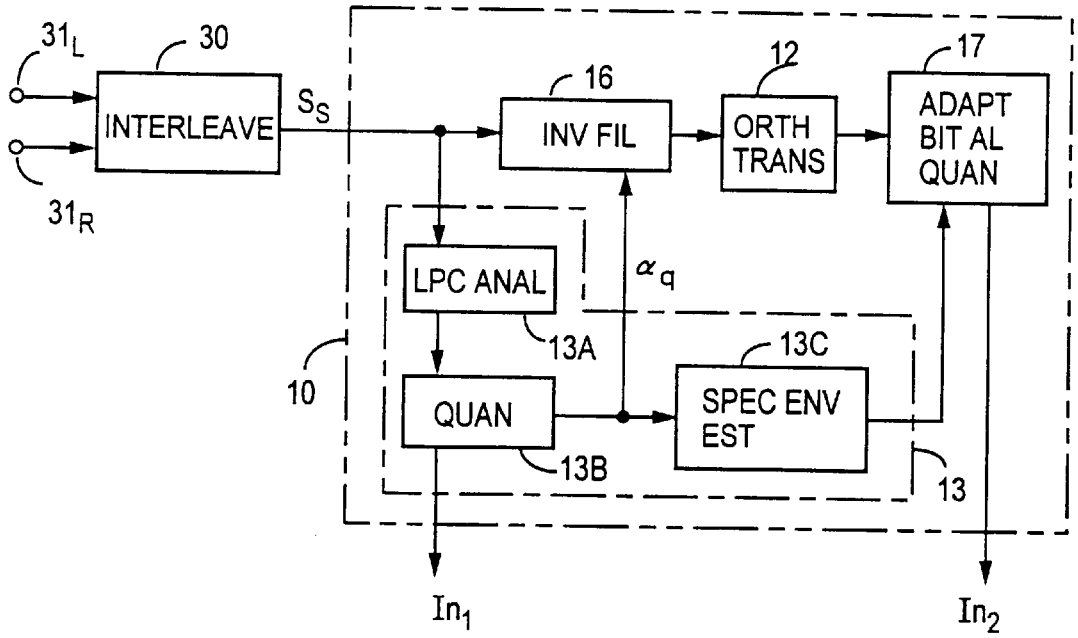
FIG. 8A is a block diagram illustrating another embodiment of the coding device using the transfer coding method.

An embodiment depicted in FIG. 8A also uses the transform coding scheme. In this embodiment, however, the coding part 10 comprises the spectral envelope estimating 13, an inverse filter 16, the orthogonal transform part 12 and the adaptive bit allocation quantization part 17. The spectral envelope estimating part 13 is composed of the LPC analysis part 13A, the quantization part 13B and the spectral envelope calculating part 13C as is the case with the FIG. 3A embodiment.

The one-dimensional sample sequence from the interleave part 30 undergoes the LPC analysis in the LPC analysis part 13A to calculate the predictive coefficients $\alpha$. These predictive coefficients $\alpha$ are quantized in the quantization part 13, from which the index In3 representing the quantization is output. At the same time, the quantized predictive coefficients $\alpha_q$ are provided to the spectral envelope calculating part 13C, wherein the spectral envelope is calculated. On the other hand, the quantized predictive coefficients $\alpha_q$ are provided as filter coefficients to the inverse filter 16. The inverse filter 16 whitens, in the time domains the one-dimensional sample time sequence provided thereto so as to flatten the spectrum thereof and outputs a time sequence of residual samples. The residual sample sequence is transformed into frequency-domain residual coefficients in the orthogonal transform part 12, from which they are provided to the adaptive bit allocation quantization part 17. The adaptive bit allocation quantization part 17 adaptively allocates bits and quantizes them in accordance with the spectral envelope fed from the spectral envelope calculating part 13C and outputs the corresponding index $In_2$.

Figure 8B:
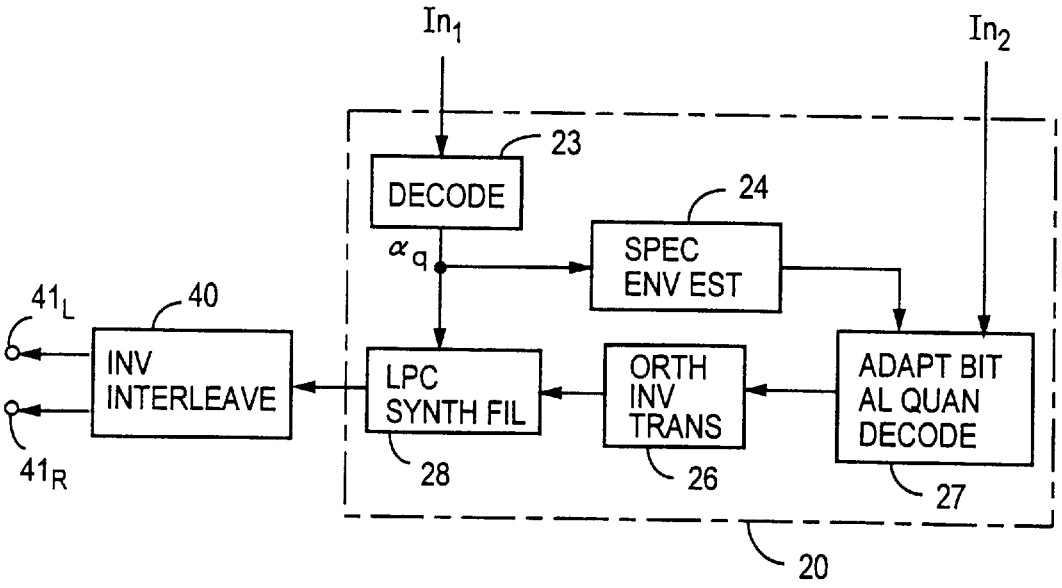
FIG. 8B is a block diagram illustrating the decoding device corresponding to the coding device of FIG. 8A.

FIG. 8B illustrates a decoding device corresponding to the coding device of FIG. 8A. The decoding part 20 in this embodiment is made up of a decoding part 23, a spectral envelope calculating part 24, an adaptive bit allocation decoding part 27, the orthogonal inverse transform part 26 and an LPC synthesis filter 28. The decoding part 23 decodes the index In1 from the coding device of FIG. 8A to obtain the quantized predictive coefficients $\alpha_q$, which are provided to the spectral envelope calculating part 24 to calculate the spectral envelope. The adaptive bit allocation decoding part 27 performs adaptive bit allocation based on the calculated spectral envelope and decodes the index $In_2$, obtaining quantized spectrum samples. The thus obtained quantized spectrum samples are transformed by the orthogonal inverse transform part 26 into a one-dimensional residual sample sequence in the time domain, which are provided to the LPC synthesis filter 28. The LPC synthesis filter 28 is supplied with decoded quantization predictive coefficients $\alpha_q$ as the filter coefficients from the decoding part 23 and uses the one-dimensional residual-coefficient sample sequence as an excitation source signal to synthesize a signal sample sequence. The thus synthesized signal sample sequence is interleaved by the inverse interleave part 40 into left- and right-channel sample sequences, which are provided to the terminals $\mathbf{41}_L$ and $\mathbf{41}_R$, respectively.

Figure 9A:
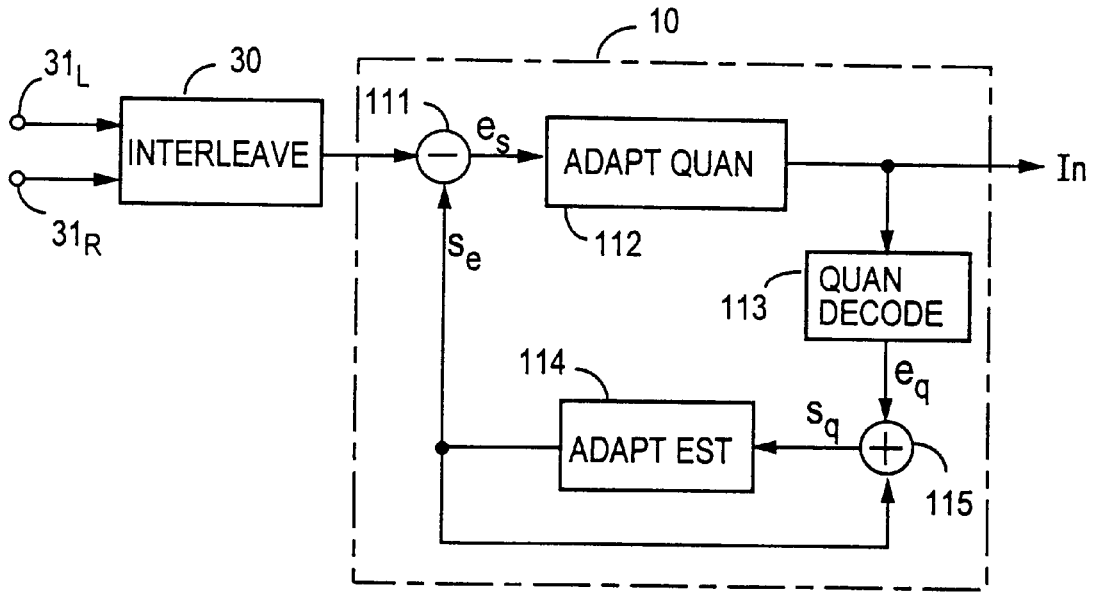
FIG. 9A is a block diagram illustrating another embodiment of the coding device using the transfer coding method.

FIG. 9A illustrates the basic construction of a coding device in which the coding part 10 uses the ADPCM scheme to perform coding through utilization of the signal correlation in the time domain. The coding part 10 is made up of a subtractor 111, an adaptive quantization part 112, a decoding part 113, an adaptive prediction part 114 and an adder 115. The signal sample sequences of the left- and right-channel are fed to the input terminals $\mathbf{31}_L$ and $\mathbf{31}_R$, and as in the case of FIG. 2A, they are interleaved in a predetermined sequential order in the interleave part 30, from which a one-dimensional sample sequence.

The one-dimensional sample sequence from the interleave part 30 is fed for each sample to the subtractor 111 of the coding part 10. A sample value Se, predicted by the adaptive prediction part 114 from the previous sample value, is subtracted from the current sample value and the subtraction result is output as a prediction error $e_S$ from the subtractor 111. The prediction error $e_S$ is provided to the adaptive quantization part 112, wherein it is quantized by an adaptively determined quantization step and from which an index In of the quantized code is output as the coded result. The index In is decoded by the decoding part 113 into a quantized prediction error value $e_q$, which is fed to the adder 115. The adder 115 adds the quantized prediction error value $e_q$ and the sample value Se predicted by the adaptive prediction part 114 about the previous sample, thereby obtaining the current Quantized sample value Sq, which is provided to the adaptive prediction part 114. The adaptive prediction part 114 generates from the current quantized sample value Sq a predicted sample value for the next input sample value and provides it to the subtractor 111.

In the coding part 10 that utilizes the ADPCM scheme, the adaptive prediction part 114 adaptively predicts the next input sample value through utilization of the correlation between adjacent samples and codes only the prediction error eS. This means utilization of the correlation between adjacent samples of the left and right channels since the input sample sequence is composed of alternately interleaved left- and right-channel samples.

Figure 9B:
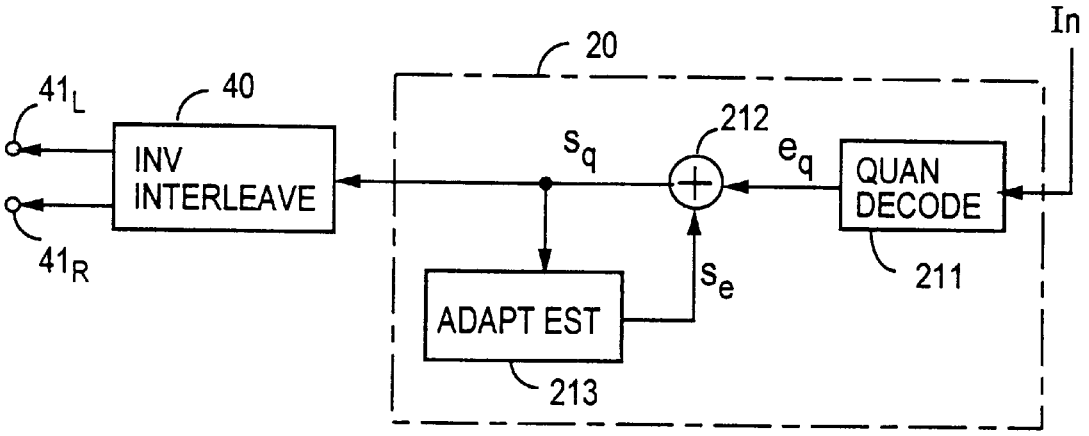
FIG. 9B is a block diagram illustrating the decoding device corresponding to the coding device of FIG. 9A.

FIG. 9B illustrates a decoding device for use with the coding device of FIG. 9A. As shown in FIG. 9B, the decoding device is composed of a decoding part 20 and an inverse interleave part 40 as is the case with FIGS. 2B. The decoding part 20 is made up of a decoding part 211, an adder 212 and an adaptive prediction part 213. The index In from the coding device is decoded in the decoding part 211 into the quantized error $e_q$, which is fed to the adder 212. The adder 212 adds the previous predicted sample value Se from the adaptive prediction part 213 and the quantized prediction error $e_q$ to obtain the quantized sample value Sq. The quantized sample value Sq is provided to the inverse interleave part 40 and also to the adaptive prediction part 213, wherein it is used for adaptive prediction of the next sample. As in the case of FIG. 2B, the inverse interleave part 40 processes the sample value sequence in reverse order to that in the interleave part 30 in FIG. 3A to distribute the sample values to the left- and right-channel sequences alternately for each sample and provides the left- and right-channel sample sequences at the output terminals $\mathbf{41}_L$ and $\mathbf{41}_R$.

Figure 10A:
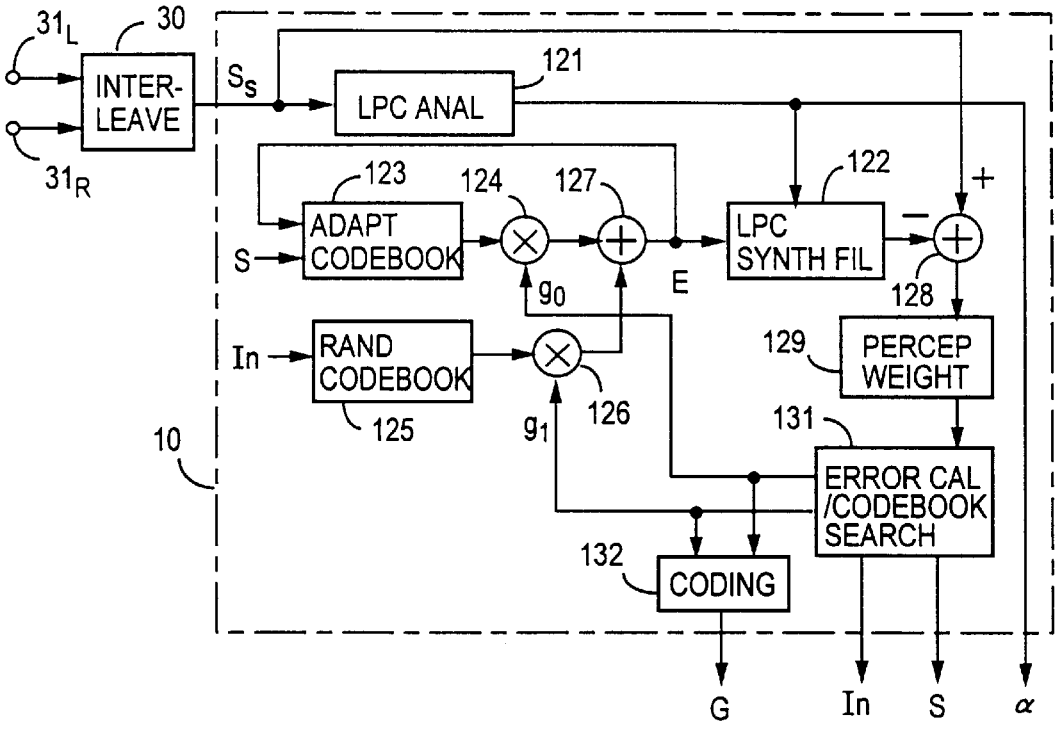
FIG. 10A is a block diagram illustrating still another embodiment of the coding device using the transfer coding method.

As another example of the coding scheme that utilizes the signal correlation in the time domains there is illustrated in FIG. 10 an embodiment in which a CELP speech coder disclosed, for example, in U.S. Pat. No. 5,195,137 is applied to the coding part 10 in FIG. 2A. The left- and right-channel stereo signal sample sequences are provided to the input terminals $\mathbf{31}_L$ and $\mathbf{31}_R$, respectively, and thence to the interleave part 30, wherein they are interleaved as described previously with reference to FIG. 4 and from which a one-dimensional sample sequence Ss is fed to an LPC analysis part 121 of the coding part 10. The sample sequence Ss is LPC-analyzed for each frame of a fixed length to calculate the LPC coefficients a, which are provided as filter coefficients to an LPC synthesis filter 122. In an adaptive codebook 123 there is stored a determined excitation vector E covering the entire frame given to the synthesis filter 122. A segment of a length S is repeatedly extracted from the excitation vector E and the respective segments are connected until the overall length becomes equal to the frame length T. By this, the adaptive codebook 123 generates and outputs an adaptive code vector (also called a periodic component vector or pitch component vector) corresponding to the periodic component of the acoustic signal. By changing the segment length S, it is possible to output an adaptive code vector corresponding to a different periodic component. In a random codebook 125 there are recorded a plurality of random code vectors of 1 frame length. Upon designation of the index In, the corresponding to the random code vector is read out of the random codebook 125. The adaptive code vector and the random code vector from the adaptive codebook 123 and the random code book 125 are provided to multipliers 124 and 125, respectively, wherein they are multiplied by weighting factors (gains) $g_0$ and $g_1$ from a distortion calculation/codebook search part 131. The multiplied outputs are added by an adder 127 and the added output is provided as the excitation vector E to the synthesis filter 122, which generates a synthesized speech signal.

In the first place, the weighting factor $g_i$ is set at zero and the difference between a synthesized acoustic signal (vector), output from the synthesis filter 122 excited by the adaptive code vector generated from the segment of the chosen length S, and the input sample sequence (vector) Ss is calculated by a subtractor 128. The error vector thus obtained is perceptually weighted in a perceptual weighting part 129, if necessary, and then provided to the distortion calculation/codebook search part 131, wherein the sum of squares of elements (the intersymbol distance) is calculated as distortion of the synthesized signal and held. The distortion calculation/codebook search part 131 repeats this processing for various segment lengths S and determines the segment length S and the weighting factor $g_0$ that minimize the distortion. The resulting excitation vector E is input into the synthesis filter 122 and the synthesized acoustic signal provided therefrom is subtracted by the subtractor 128 from an input signal AT to obtain a noise or random component. Then a noise code vector that minimizes distortion is selected from the random codebook 125, with the noise component set as a target value of synthesized noise when using the noise code vector as the excitation vector E. By this, the index In is obtained which corresponds to the selected noise code vector. From thus determined noise code vector is calculated the weighting factor $g_1$ that minimizes the distortion. The weighting factors $g_0$ and $g_1$ determined as mentioned above are calculated as a weighting code $G=(g_0, g_1)$ in a coding part 132. The LPC coefficients $\alpha$, the segment length S, the noise code vector index In and the weighting code G determined for each frame of the sample sequence Ss as described above are output from the coding device of FIG. 10A as codes corresponding to the sample sequence Ss.

Figure 10B:
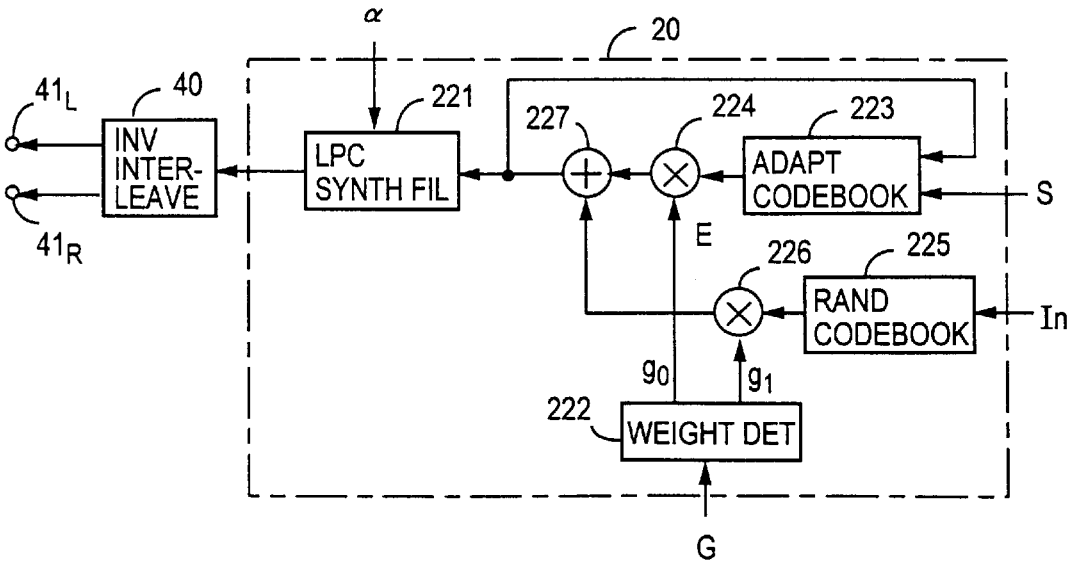
FIG. 10B is a block diagram illustrating the decoding device corresponding to the coding device of FIG. 10A.

In the decoding device, as shown in FIG. 10B, the LPC coefficients $\alpha$ are set as filter coefficients in an LPC synthesis filter 221. Based on the segment length S and the index In from the coding device of FIG. 10A, an adaptive code vector and a noise code vector are output from an adaptive codebook 223 and a random codebook 225, respectively, as in the coding device. These code vectors are multiplied by the weighting factors $g_0$ and $g_1$ from a weighting factor decoding part 222 in multipliers 224 and 226, respectively. The multiplied outputs are added together by an adder 227. The added output is provided as an excitation vector to the LPC synthesis filter 221. As the result of this, the sample sequence Ss is restored or reconstructed and provided to the inverse interleave part 40. The processing in the inverse interleave part 40 is the same as in the case of FIG. 3B.

As will be seen from the above, the coding method for the coding part 10 of the coding device according to the present invention may be any coding methods which utilize the correlation between samples, such as the transfer coding method and the LPC method. The multichannel signal that is input into the interleave part 30 is not limited specifically to the stereo signal but may also be other acoustic signals. In such an instance, too, there is often a temporary correlation between the sample value of a signal of a certain channel and any one of sample values of any other channels. The coding method according to the present invention permits prediction from a larger number of previous samples than in the case of the LPC analysis using only one channel signal, and hence it provides an increased prediction gain and ensures efficient coding.

Figure 11:
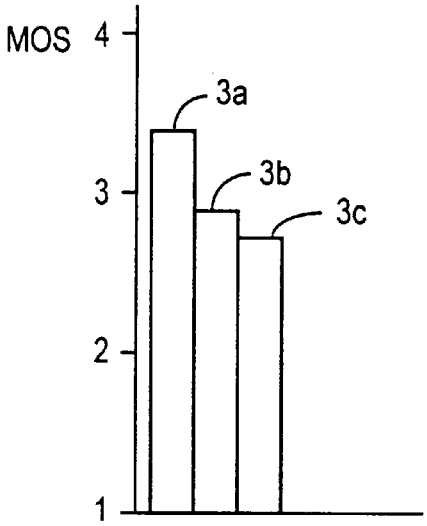
FIG. 11 is a graph showing the results of subjective signal quality evaluation tests on the embodiments of FIGS. 3A and 3B.

FIG. 11 shows the results of subjective signal quality evaluation tests on the stereo signals produced using the coding method in the embodiments of FIGS. 3A and 3B. Five grades of MOS (Mean Opinion Score) values were used and examinees or listeners aged 19 to 25 were 15 persons engaged in the music industry. The bit rate is 28 kbit/s by TwinVQ. In FIG. 11, reference numeral 3*a* indicates the case where the embodiment of FIGS. 3A and 3B was used, 3*b* the case where the quantization method was used taking into account the energy difference between left- and right-channel signals, and 3*c* the case where left- and right-channel signals were coded independently of each other. From the results shown in FIG. 11 it is understood that the evaluation of the signal quality by the coding method according to the present invention is highest.

Figure 12A:
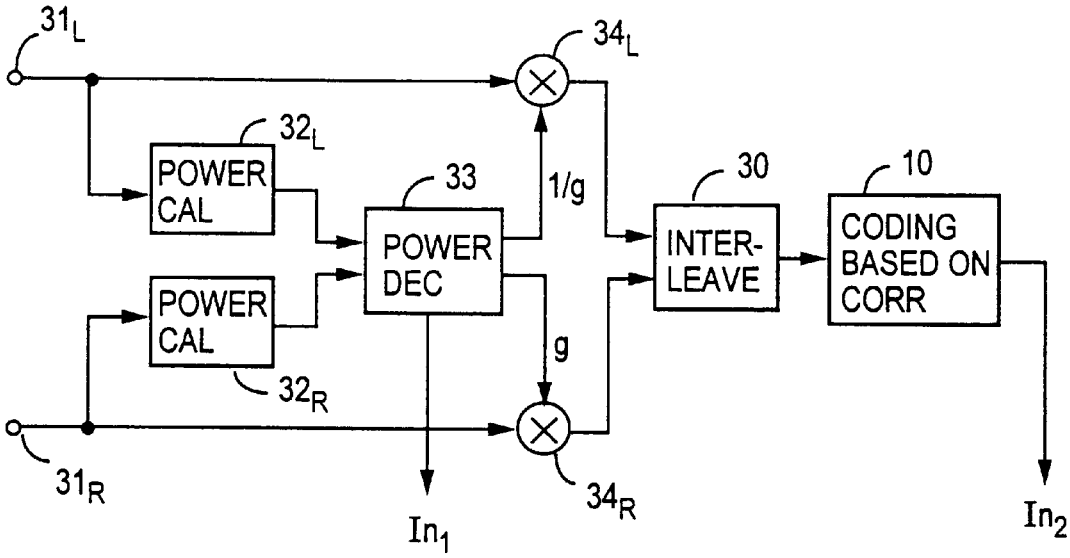
FIG. 12A is a block diagram illustrating a modified form of the FIG. 2A embodiment which reduces the difference in power between channels.
Figure 12B:
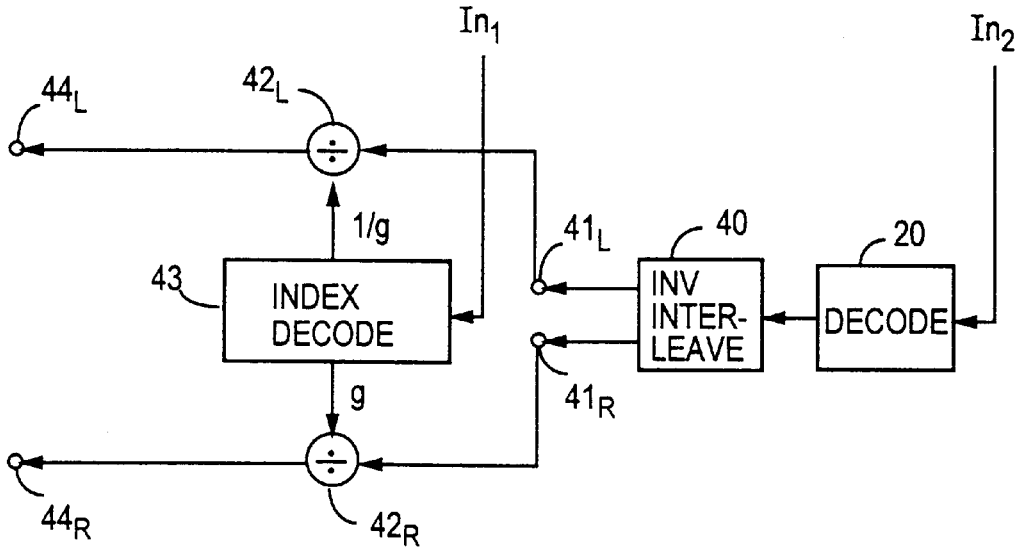
FIG. 12B is a block diagram illustrating the decoding device corresponding to the coding device of FIG. 12A.

In each embodiment described above, in the time interval during which a large power difference occurs between channels due to a temporal variation in the input acoustic signal of the interleave part 30, the influence of the relative quantization distortion on a channel signal of small power grows, making it impossible to maintain high signal quality. In FIGS. 12A and 12B there are illustrated in block form, as modifications of the basic constructions of the present invention depicted in FIGS. 2A and 2B, embodiments of coding and decoding methods that solve the above-mentioned defect and, even in the case of an imbalance in signal power occurring between the channels, prevents only the small-powered channel from being subject to quantization distortion, thereby producing a high-quality coded acoustic signal. The illustrated embodiments will be described to use two left- and right-channel signals.

In FIGS. 12A and 12B the parts corresponding to those in FIGS. 2A and 2B are identified by the same references. The coding device of FIG. 12A differs from that of FIG. 2A in the provision of power calculating parts 32L and 32R, a power decision part 33 and power balancing parts $\mathbf{34}_L$ and $\mathbf{34}_R$. The decoding device of FIG. 12B differs from that of FIG. 2A in the provision of an index decoding part 43 and power inverse-balancing parts $\mathbf{42}_L$ and $\mathbf{42}_R$. A description will be given of coding and decoding, focusing on the above-mentioned parts.

The left- and right-channel signals at the input terminals $\mathbf{31}_L$ and $\mathbf{31}_R$ are input into the poser calculating parts $\mathbf{32}_L$ and $\mathbf{32}_R$, respectively, wherein their power values are calculated for each time interval, that is for each frame period of coding. Based on the power values fed from the power calculating parts $\mathbf{32}_L$ and $\mathbf{32}_R$, the power decision part 33 determines coefficients by which the left- and right-channel signals are multiplied in the power balancing parts $\mathbf{34}_L$ and $\mathbf{34}_R$ so that the difference in power between the both signals is reduced. The power decision part 33 sends the coefficients to the power balancing parts $\mathbf{34}_L$ and $\mathbf{34}_R$ and outputs indexes $In_1$ representing the both coefficients.

Since the balancing is intended to reduce the power difference between the left- and right-channel signal, it is evident that the power magnitudes of the left- and right-channel signals may be balanced, for instance, by multiplying only the channel signal of the smaller power magnitude by a coefficient g. For example, letting the power of the left-channel signal by $W_L$ and the power of the right-channel signal by $W_R$, $k=W_L/W_R$ is calculated. If $k>1$, then the right-channel signal is multiplied by $g=k^r$ (where r is a constant approximately ranging from 0.2 to 0.4, for instance) in the power balancing part $\mathbf{34}_R$. The multiplied output is provided to the interleave part 30, whereas the left-channel signal is applied intact to the interleave part 30. If $0<k<1$, then the left-channel signal is multiplied by $1/g=k^{-r}$ in the power balancing part $\mathbf{34}_L$ and the multiplied output is applied to the interleave part 30. The right-channel signal is provided intact to the interleave part 30. Setting r=1, the distortion of the signal of the smaller amplitude is minimized but the distortion of the signal of the larger amplitude increases. Setting r=0, the signal of the smaller amplitude is naturally distorted. Hence, the constant r may preferably be set intermediate between 1 and 0. For example, when the power of the input acoustic signal is rapidly undergoing a large variation, the corresponding rapid power balancing of the left- and right-channel signals is not always optimum from the perceptual point of view. Setting the constant r in the range of 0.2 to 0.4, it may sometimes be possible to obtain the best acoustic signal in terms of perception.

In the power balancing parts $\mathbf{34}_L$ and $\mathbf{34}_R$, the right- or left-channel signal is multiplied by the coefficient 8 of 1/g defined by the index, by which the power difference between the both channel signals is reduced. The multiplied output is provided to the interleave part 30. The subsequent coding procedure in the coding part 10 is exactly the same as the coding procedure by the coding method by the coding part 10 in FIG. 2A. In practice, any of the coding methods of the coding devices in FIGS. 3A, 6A, 7A, 8A and 10A may be used.

In the decoding device depicted in FIG. 12B, the left- and right-channel signal sample sequences are provided at the output terminals $\mathbf{41}_L$ and $\mathbf{41}_R$ of the inverse interleave part 40 by the same processing as in the decoding part 20 and the inverse interleave part 40 depicted in FIG. 2B. In the index decoding part 43, the coefficient g or 1/g which corresponds to the index $In_1$ provided from the power decision part 33 in FIG. 12A. In the power inverse-balancing part $\mathbf{42}_L$ or $\mathbf{42}_R$, the left- or right-channel signal is inverse-balanced through division by the corresponding coefficient g or 1/g; that is, the left- and right-channel signals with the power difference therebetween increased are provided at the output terminals $\mathbf{44}_L$ and $\mathbf{44}_R$, respectively.

In the power decision part 33 the coefficient for power balancing may be determined as described below. That is, as depicted in the table of FIG. 13, the region of the value k=WL or 1/g is split into a plurality of sub-regions and the coefficient g or 1/g, by which the signal power $W_R$ or $W_L$ is multiplied, is predetermined in each sub-region so that the coefficient g or 1/g increases with an increase in k or 1/k. The power decision part 33 prestores the table of FIG. 13; it selects from the prestored table the coefficient g or 1/g, depending on the sub-region to which the value k or 1/k belongs. The power decision part 33 outputs a code corresponding to the selected coefficient as the index $In_1$. In the index decoding part 43 of the decoding device of FIG. 12B, too, the table of FIG. 13 is provided, from which the coefficient g or 1/g corresponding to the index $In_1$ from the power decision part 33 is selected and provided to the inverse-balancing part $\mathbf{42}_L$ or $\mathbf{42}_R$.

Figure 14A:
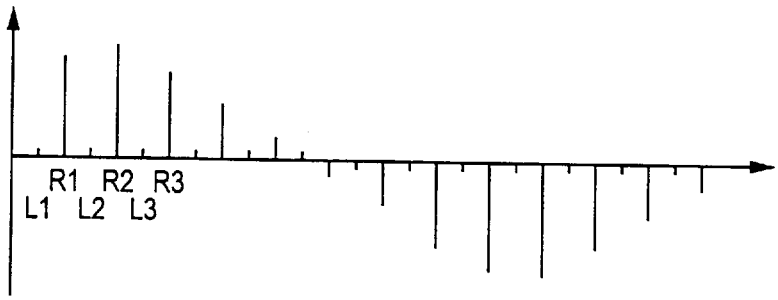
FIGS. 14A and B are graphs showing the relationship between inter-channel power imbalance and a one-dimensional signal sample sequence after interleave.
Figure 14B:
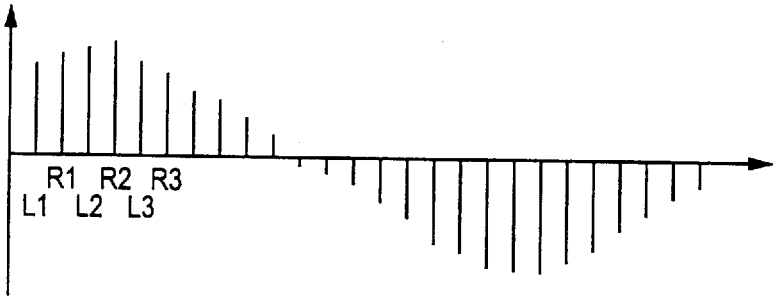

For example, in the case where left-channel signals L1, L2, . . . of a two-channel stereo acoustic signal are appreciably small in power in a certain time period but right-channel signals are considerably large in power, the output from the interleave part 30 in FIG. 2A becomes such a one-dimensional signal as shown in FIG. 14A and the relative quantization distortion of the left-channel signals increases, resulting in the quality of the decoded left-channel acoustic signal being degraded. With the coding and decoding devices of FIGS. 12A and 12B, however, when the left-channel signal is small in power but the right-channel signal is large in power, the output from the interleave part 30 in FIG. 12A is balanced as depicted in FIG. 14B, for instance, and the power difference decreases accordingly, preventing that only the left-channel signal is greatly affected by quantization distortion.

Figure 15:
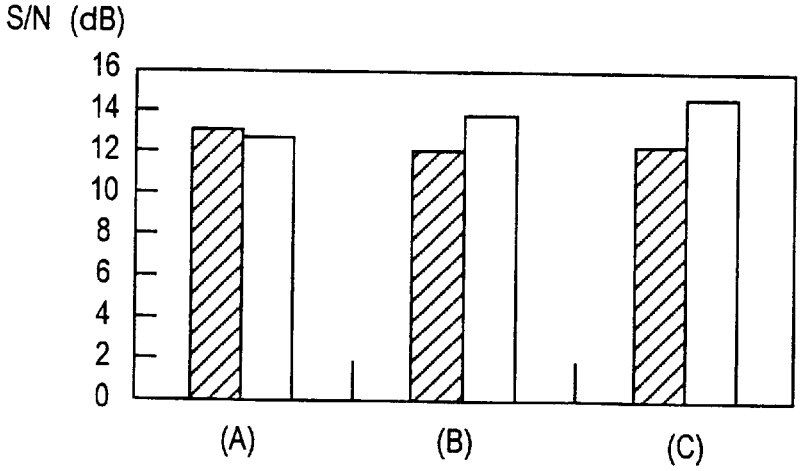
FIG. 15 is a graph showing the results of computer simulations on the SN ratios of input and decoded acoustic signals.

FIG. 15 is a graph sowing the SN ratios between input and decoded acoustic signals in the cases (A) where the left- and right-channel signals are of the same power, (B) where the left- and right-channel signals have a power difference of 10 dB and (C) where only one of the left- and right-channel signals has power in the embodiments of the coding and decoding methods shown in FIGS. 2A, 2B and 12A, 12B. The hatched bars indicate the SN ratios in the embodiments of FIGS. 2A and 2B, and the unhatched bars the SN ratios in the embodiments of FIGS. 12A and 12B. The coding part 10 and the decoding part 20 used are those shown in FIGS. 3A and 3B. The transmission rate of the coded output was set at 20 kbit/s and computation simulations were done with the frame length set at 40 ms and the sampling frequency at 16 kHz. The signal level of the one channel was manually adjusted to optimize the decoded acoustic signal. $\lambda$ at that time was substantially in the range of 0.2 to 0.4. From the graph of FIG. 15 it is seen that the SN ratios in the embodiments of FIGS. 12A and 12B are better than in the embodiments of FIGS. 2A and 2B.

While in the embodiments of FIGS. 12A and 12B the present invention has been described as being applied to the two left- and right-channel stereo signal, the invention is applicable to signals of three or more channels. The coding and decoding devices 10 and 20 are often designed to decode and execute a program by DSP (Digital Signal Processor); the present invention is also applicable to a medium with such a program recorded thereon.

EFFECT OF THE INVENTION

As described above, according to the present invention, signal sample sequences of plural channels are interleaved into a one-dimensional signal sample sequence, which is coded as a signal sample sequence of one channel through utilization of the correlation between the sample. This permits coding with a high prediction gain, and hence ensures efficient coding. Further, such an efficiently coded code sequence can be decoded.

By interleaving the signal sample sequences after reducing the power imbalance between the channels in the coding device, it is possible to prevent that only the small-powered channel signal is greatly affected by quantization distortion when the power imbalance occurs due to power variations of plural channels. Accordingly, the present invention permits high-quality coding and decoding of any multichannel signals.

It will be apparent that many modifications and variations may be effected without departing from the scope of the novel concepts of the present invention.

What is claimed is:

1. A multichannel acoustic signal coding method comprising the steps of:

(a) interleaving acoustic signal, sample sequences of plural channels into a one-dimensional signal sequence under a certain rule; and (b) coding said one-dimensional sample sequence by a coding method utilizing the correlation between a number of samples from different channels of said plural channels in the one-dimensional signal sequence and outputting a code.

2. The coding method of claim 1, further comprising, prior to said step (a), the steps of:

(0-1) calculating the power of said acoustic signal sample sequence of each of said plural channels for each certain time period; and (0-2) reducing the difference in power between said acoustic signal sample sequences of said plural channels on the basis of said power calculated for each channel and using said acoustic signal sample sequences of said plural channels with their power difference reduced, as said acoustic signal sample sequences of said plural channels in said step (a).

3. The coding method of claim 1 or 2, wherein said coding in said step (b) comprises the steps of:

(b-1) generating frequency-domain coefficients by orthogonal-transforming said one-dimensional signal sample sequence;

(b-2) estimating a spectral envelope of said frequency-domain coefficients and outputting a first quantization code representing said estimated spectral envelope;

(b-3) generating spectrum residual coefficients by normalizing said frequency-domain coefficients with said estimated spectral envelope; and (b-4) quantizing said spectrum residual coefficients and outputting a quantization code.

4. The coding method of claim 3, wherein said step (b-2) comprises a step of estimating said spectral envelope by LPC-analyzing said one-dimensional signal sample sequence.

5. The coding method of claim 3, wherein said step (b-2) comprises a step of estimating said spectral envelope from said frequency-domain coefficients.

6. The coding method of claim 3, wherein said quantization in said step (b-4) is a vector quantization.

7. The coding method of claim 3, wherein said quantization in said step (b-4) comprises the steps of:

(b-4-1) estimating a residual-coefficient envelope from said spectrum residual coefficients;

(b-4-2) generating fine structure coefficients by normalizing said spectrum residual coefficients with said residual-coefficient envelope;

(b-4-3) generating weighting factors based on said residual-coefficient envelope and outputting as part of said code an index indicating said weighting factors; and (b-4-4) performing weighted vector quantization of said fine structure coefficients through the use of said weighting factors and outputting its quantization index as the other part of said code.

8. The coding method of claim 1 or 2, wherein said coding in said step (b) comprises the steps of:

(b-1) generating frequency-domain coefficients by orthogonal-transforming said one-dimensional signal sample sequence;

(b-2) estimating a spectral envelope of said frequency-domain coefficients and outputting as part of said code an index representing said estimated spectral envelope; and (b-3) performing a bit allocation based on at least said spectral envelope, performing an adaptive bit allocation quantization of said frequency-domain coefficients and outputting as the other part of said code an index indicating said quantization.

9. The coding method of claim 8, wherein said step (b-2) includes a step of estimating said spectral envelope by LPC-analyzing said one-dimensional signal sample sequence.

10. The coding method of claim 8, wherein said step (b-2) includes a step of estimating said spectral envelope from said frequency-domain coefficients.

11. The coding method of claim 1 or 2, wherein said coding in said step (b) comprises the steps of:

(b-1) obtaining predictive coefficients by LPC-analyzing said one-dimensional signal sample sequence;

(b-2) generating quantization predictive coefficients by quantizing said predictive coefficients and outputting as part of said code an index indicating said quantization;

(b-3) generating a residual sample sequence by inversely filtering said one-dimensional signal sample sequence, using said quantization predictive coefficients as filter coefficients;

(b-4) generating residual spectrum by orthogonal transformation of said residual sample sequence;

(b-5) generating a spectral envelope from said quantization predictive coefficients; and (b-6) determining a bit allocation based on at least said spectral envelope, performing an adaptive bit allocation quantization of said residual spectrum and outputting as the other part of said code an index indicating said quantization.

12. The coding method of claim 1 or 2, wherein said coding in said step (b) comprises the steps of:

(b-1) obtaining predictive coefficients by LPC-analyzing said one-dimensional signal sample sequence;

(b-2) generating quantization predictive coefficients by quantizing said predictive coefficients and outputting as part of said code an index indicating said quantization;

(b-3) generating a residual sample sequence in the time domain by an inverse filter applied to said one-dimensional signal sample sequence, using said quantization predictive coefficients as filter coefficients;

(b-4) generating residual spectrum by orthogonal-transforming said residual sample sequence;

(b-5) generating a spectral envelope from said quantization predictive coefficients; and (b-6) determining weighting factors based on at least said spectral envelope, performing a weighted vector quantization of said residual-coefficient spectrum and outputting as the other part of said code an index indicating said quantization.

13. The coding method of claim 1 or 2, wherein said step (b) includes a step of coding said one-dimensional signal sample sequence by ADPCM.

14. The coding method of claim 10, wherein said step (b) comprises the steps of:

(b-1) calculating an prediction error of a prediction value for each sample of said one-dimensional signal sample sequence;

(b-2) adaptively quantizing said prediction error and outputting as part of said code an index indicating said quantization;

(b-3) obtaining said quantized prediction error by decoding said index;

(b-4) generating a quantized sample by adding said prediction value to said quantized prediction error; and (b-5) generating a prediction value for the next sample of said one-dimensional signal sample sequence on the basis of said quantized sample.

15. The coding method of claim 1 or 2, wherein said coding in said step (b) is coding of said one-dimensional signal sample sequence by CELP.

16. The coding method of claim 15, wherein said step (b) comprises the steps of:

(b-1) obtaining predictive coefficients by LPC-analyzing said one-dimensional signal sample sequence for each frame, providing said predictive coefficients as filter coefficients to a synthesis filter and outputting them as part of said code; and (b-2) generating an excitation vector for the current frame by an excitation vector segment extracted from an excitation vector of the previous frame for each synthesis filter so that distortion between said one-dimensional signal sample sequence and a synthesized acoustic signal sample sequence by said synthesis filter is minimized, and outputting as the other part of said code an index indicating extracted segment length.

17. The coding method of claim 3, wherein the frequency band covering said frequency-domain coefficients is divided into plural frequency bands, said coding is performed for each frequency band and a combination of codes of said plurals frequency bands is selectively output in accordance with the output environment of said code.

18. The coding method of claim 8, wherein the frequency band covering said frequency-domain coefficients is divided into plural frequency bands, said coding is performed for each frequency band and a combination of codes of said plural frequency bands is selectively output in accordance with the output environment of said code.

19. The coding method of claim 12, wherein the frequency band covering said frequency-domain coefficients is divided into plural frequency bands, said coding is performed for each frequency band and a combination of codes of said plural frequency bands is selectively output in accordance with the output environment of said code.

20. The coding method of claims 2, wherein said plural channels are left and right channels and herein said step (0-2) comprises a step of multiplying, by a balancing factor equal to or greater than 1, that of acoustic signal sample sequence of said left- and right channels which is of the smaller power while maintaining the acoustic signal sample sequence of the other of said left and right channels intact, and outputting as part of said code an index indicating said balancing factor.

21. The coding method of claim 20, wherein a power ratio k between said left and right channels, and when said ratio is equal to or greater than 1, said acoustic signal sample sequence of the channel of the smaller power is multiplied by $8=k^r$ as said balancing factor and when $0<k<1$, said acoustic signal sample sequence of the channel of the smaller power is multiplied by 1/g as said balancing factor, said r being a constant defined by $0<r<1$.

22. The coding method of claim 20, further comprising the steps of:

calculating a power ratio k between said left and right channels;

deciding which of predetermined plural sub-regions said value k belongs to, said plural sub-regions being divided from a region over which said value k is made possible; and multiplying said acoustic signal sample sequence of the channel of the smaller power by that one of predetermined for respective sub-regions which corresponds to said decided sub-region, and providing a code indicating said decided sub-region as an index indicating said balancing factor.

23. A decoding method for decoding codes coded by interleaving acoustic signal sample sequences of plural channels into a one-dimensional signal sample sequence under a certain rule, said decoding method comprising the steps of:

(a) decoding an input code sequence into said one-dimensional signal sequence by a decoding method corresponding to a coding method utilizing the correlation between a number of samples from different channels of said plural channels in said one-dimensional signal sequence; and (b) distributing said decoded one-dimensional signal sequence to said plural channels by a procedure reverse to that of said certain rule, thereby obtaining said acoustic signal sample sequences of said plural channels.

24. The decoding method of claim 23, further comprising the steps of:

decoding an input power correction index to obtain a balancing factor; and correcting said acoustic signal sample sequences of said plural channels by said balancing factor to increase a power difference between them, thereby obtaining decoded acoustic signal sample sequences of plural channels.

25. The decoding method of claim 23 or 24, wherein said decoding in said step (a) comprises the steps of:

(a-1) decoding an input first quantization code to obtain a spectrum residue;

(a-2) decoding an input second quantization code to obtain a spectral envelope;

(a-3) multiplying said spectrum residue and said spectral envelope to obtain frequency-domain coefficients; and (a-4) performing an orthogonal inverse transformation of said frequency-domain coefficients to obtain said one-dimensional signal sample sequence in a time domain.

26. The decoding method of claim 25, wherein said step (a-2) comprises a step of decoding said second quantization code to obtain LPC coefficients and calculating said spectral envelope from said LPC coefficients.

27. The decoding method of claim 25, wherein said decoding in said step (a-1) is vector decoding.

28. The decoding method of claim 26, wherein said first quantization code includes first and second indexes and said step (a-1) comprises the steps of:

(a-1-1) decoding said first index to restore spectrum fine structure coefficients;

(a-1-2) decoding said second index to obtain a residual-coefficient envelope; and (a-1-3) de-normalizing said spectrum fine structure coefficients with said residual-coefficient envelope to obtain said spectrum residue.

29. The decoding method of claim 23 or 24, wherein said step (a) comprises the steps of:

(a-1-1) frequency-domain coefficients, by adaptive bit allocation decoding, from an input first quantization code indicating quantized frequency-domain coefficients and an input second quantization code indicating a quantized spectral envelope; and (a-1-2) performing an orthogonal inverse transformation of said frequency-domain coefficients to obtain said one-dimensional signal sample sequence.

30. The decoding method of claim 23 or 24, wherein said step (a) comprises the steps of:

(a-1-1) obtaining LPC coefficients by decoding an input first quantization code indicating quantized LPC coefficients;

(a-1-2) estimating a spectral envelope from said LPC coefficients;

(a-1-3) obtaining a residual-coefficient spectrum by adaptive bit allocation decoding of an input second quantization code indicating a quantized residual-coefficient spectrum, through bit allocations based on said spectral envelope;

(a-1-4) performing an orthogonal inverse transformation of said residual-coefficient spectrum to obtain an excitation signal sample sequence; and (a-1-5) obtaining said one-dimensional signal sample sequence by processing said excitation signal sample sequence with a synthesis filter using said LPC coefficients as filter coefficients.

31. The decoding method of claim 23 or 24, wherein said step (a) comprises the steps of:

(a-1-1) obtaining a spectral residual by vector-decoding an input first vector quantization code indicating vector-quantized spectral residual;

(a-1-2) obtaining a spectral envelope by vector-coding an input second vector quantization code indicating a vector-quantized spectral envelope;

(a-1-3) obtaining frequency-domain coefficients by multiplying said spectral residual and said spectral envelope for corresponding samples thereof; and (a-1-4) performing an orthogonal inverse transformation of said frequency-domain coefficients to obtain said one-dimensional signal sample sequence.

32. The decoding method of claim 23 or 24, wherein said step (a) comprises the steps of:

(a-1-1) obtaining a quantized prediction error by decoding an input quantization code indicating said quantized prediction error;

(a-1-2) adaptively predicting the current sample value from the previous decoded sample;

(a-1-3) adding said quantized prediction error to a predicted version of said sample value to obtain the current decoded sample value; and (a-1-4) repeating said steps (a-1-1), (a-1-2) and (a-1-3) to obtain said one-dimensional signal sample sequence.

33. The decoding method of claim 23 or 24, wherein said step (a) comprises the steps of:

(a-1-1) generating an excitation vector of the current frame by extracting from an excitation vector of the previous frame a segment of a length designated by an input index indicating the segment length of said excitation vector; and (a-1-2) setting input LPC coefficients as filter coefficients in a synthesis filter and processing said excitation vector of said current frame by said synthesis filter to obtain said one-dimensional signal sample sequence.

34. The decoding method of claim 25, wherein a set of said first and second quantization codes is input for each of predetermined plural frequency bands, the set of said quantization codes for a desired one of said plural frequency band is selected and decoded to obtain frequency-domain coefficients of the selected frequency band, and performing orthogonal inverse transformation of said frequency-domain coefficients.

35. The decoding method of claim 29, wherein a set of said first and second quantization codes is input for each of predetermined plural frequency bands, the set of said quantization codes for a desired one of said plural frequency band is selected and decoded to obtain frequency-domain coefficients of the selected frequency band, and performing orthogonal inverse transformation of said frequency-domain coefficients.

36. The decoding method of claim 31, wherein a set of said first and second quantization codes is input for each of predetermined plural frequency bands, the set of said quantization codes for a desired one of said plural frequency band is selected and decoded to obtain frequency-domain coefficients of the selected frequency band, and performing orthogonal inverse transformation of said frequency-domain coefficients.

37. The decoding method of claim 24, wherein said plural channels are two left and right channels, said decoded balancing factor is equal to or greater than 1, and that one of said acoustic signal sample sequences of said left and right channels which is of the smaller power is divided by said balancing factor to obtain decoded acoustic signal sample sequences of said left and right channels.

38. A multichannel acoustic signal coding device comprising:

interleave means for interleaving acoustic signal sample sequences of plural channels into a one-dimensional signal sequence under a certain rule; and coding means for coding said one-dimensional signal sequence by a coding method utilizing the correlation between a number of samples from different channels, of said plural channels in said one-dimensional signal sequence and for outputting the code.

39. The coding device of claim 38, further comprising at a stage preceding said interleave means:

power calculating means for calculating the power of each of said acoustic signal sample sequences of said plural channels for each certain time period;

power decision means for determining the correction of said power based on said calculated power so that a power difference between input acoustic signal sample sequences of said plural channels is reduced; and power correcting means provided in each channels, for correcting the power of said input acoustic signal sample sequence of said each channel by said power balancing factor and for providing said corrected input acoustic signal sample.

40. The coding device of claim 38 or 39, wherein said coding means comprises:

orthogonal transform means for orthogonal-transforming said one-dimensional signal sample sequence into frequency-domain coefficients;

spectral envelope estimating means for estimating a spectral envelope of said frequency-domain coefficients and for outputting a first quantization code indicating said estimated spectral envelope;

frequency-domain coefficient normalizing means for normalizing said frequency-domain coefficients by said spectral envelope to generate a spectrum residue; and quantization means for quantizing said spectrum residue and for outputting its quantization code.

41. The coding device of claim 40, wherein said spectral envelope estimating means comprises LPC analysis means for LPC-analyzing said one-dimensional signal sample sequence to estimate said spectral envelope.

42. The coding device of claim 40, wherein said spectral envelope estimating means comprises means for estimating said spectral envelope from said frequency-domain coefficients.

43. The coding device of claim 40, where in said quantization means is vector quantization means.

44. The coding device of claim 40, wherein said quantization means comprises:

residual-coefficient envelope estimating means for estimating a residual-coefficient envelope from said spectrum residue and for outputting as part of said code an index indicating said residual-coefficient envelope;

spectrum normalizing means f or normalizing said spectrum residue by said residual-coefficient envelope to generate fine structure coefficients;

weighting factor calculating means for generating weighting factors based on at least said residual-coefficient envelope; and quantization means for weighted-vector-quantizing said fine structure coefficients by the use of said weighting factors and for outputting its quantization index as the other part of said code.

45. The coding device of claim 38 or 39, wherein said coding means comprises:

orthogonal transform means for orthogonal-transforming said one-dimensional signal sample sequence to generate frequency-domain coefficients;

spectral envelope estimating means for estimating a spectral envelope of said frequency-domain coefficients and for outputting as part of said code an index indicating said estimated spectral envelope; and quantization means for performing a bit allocation on the basis of at least said spectral envelope, for performing adaptive bit allocation quantization of said of said frequency-domain coefficients and for outputting as the other part of said code an index indicating said quantization.

46. The coding device of claim 38 or 39, wherein said coding means comprises:

LPC analysis means for LPC-analyzing said one-dimensional signal sample sequence to obtain predictive coefficients;

predictive coefficient quantization means for quantizing said predictive coefficients to generate quantized predictive coefficients and for outputting as part of said code an index indicating said quantization;

inverse filter means supplied with said quantizes predictive coefficients as filter coefficients for inverse-filtering said one-dimensional signal sample sequence to generate a residual sample sequence;

orthogonal transform means for orthogonal-transforming said residual sample sequence to generate residual spectrum samples;

spectral envelope estimating means for estimating a spectral envelope from said quantized predictive coefficients; and weighted vector quantization means for determining weighting factors on the basis of at least said spectral envelopes for weighted-vector-quantizing said residual spectrum and for outputting as the other part of said code an index indicating said quantization.

47. The coding device of claim 45, wherein said spectral envelope estimating means includes means for LPC-analyzing said one-dimensional signal sample sequence to estimate said spectral envelope.

48. The coding device of claim 45, wherein said spectral envelope estimating means includes means for estimating said spectral envelope from said frequency-domain coefficients.

49. The coding device of claim 38 or 39, wherein said coding means comprises:

LPC analysis means for LPC-analyzing said one-dimensional signal sample sequence to obtain predictive coefficients;

predictive coefficient quantization means for quantizing said predictive coefficients to generate quantized predictive coefficients and for outputting as part of said code an index indicating said quantization;

inverse filter means supplied with said quantizes predictive coefficients as filter coefficients, for inverse-filtering said one-dimensional signal sample sequence to generate a residual sample sequence;

orthogonal transform means for orthogonal-transforming said residual sample sequence to generate residual spectrum;

spectral envelope estimating means for estimating a spectral envelope from said quantized predictive coefficients; and adaptive bit allocation quantization means for determining a bit allocation on the basis of at least said spectral envelope, for performing an adaptive bit allocation quantization of said residual spectrum and for outputting as the other part of said code an index indicating said quantization.

50. The coding device of claim 38 or 39, wherein said coding means is means for coding said one-dimensional signal sample sequence by ADPCM.

51. The coding device of claim 50, wherein said coding means comprises:

subtractor means for calculating an prediction error of a predictive value for each sample of said one-dimensional signal sample sequence;

adaptive quantization means for adaptively quantizing said prediction error and for outputting as part of said code an index indicating said quantization;

decoding means for decoding said index to obtain said quantized prediction error;

adder means for adding said prediction value to said quantized prediction error to generate a quantized sample; and adaptive predicting means for generating a prediction value for the next sample of said one-dimensional signal sample sequence on the basis of said quantized sample.

52. The coding device or claim 38 or 39, wherein said coding means is means for coding said one-dimensional signal sample sequence by CELP.

53. The coding device of claim 52, wherein said coding means comprises:

LPC analysis means for LPC analyzing said one-dimensional signal sample sequence for each frame to obtain predictive coefficients and for outputting said predictive coefficients as part of said code;

an adaptive codebook for holding an excitation vector of the previous frame and for generating an excitation vector of the current frame from a vector segment extracted from said excitation vector of said previous frame;

synthesis filter means supplied with said predictive coefficients as filter coefficients, for generating a synthesized acoustic signal sample sequence from said excitation vector of said current frame; and distortion calculation/codebook search means for controlling the length of said vector segment to be extracted from said excitation vector of said previous frame in such a manner as to minimize distortion between said one-dimensional signal sample sequence and said synthesized acoustic signal sample sequence and for outputting as the other part of said code an index indicating the length of said vector segment to be extracted.

54. The coding device of claim 40, wherein the frequency band covering said frequency-domain coefficients is divided into plural frequency bands, said coding is performed for each frequency band and a combination of codes of said plural frequency bands is selectively output in accordance with the output environment of said code.

55. The coding device of claim 45, wherein the frequency band covering said frequency-domain coefficients is divided into plural frequency bands, said coding is performed for each frequency band and a combination of codes of said plural frequency bands is selectively output in accordance with the output environment of said code.

56. The coding device of claim 49, wherein the frequency band covering said frequency-domain coefficients is divided into plural frequency bands, said coding is performed for each frequency band and a combination of codes of said plural frequency bands is selectively output in accordance with the output environment of said code.

57. The coding device of claim 39, wherein: said plural channels are two left and right channels; said power decision means is means for determining that one of said left and right channels which is of the smaller power, for providing to power correcting means of that channel a balancing factor equal to or greater than 1, and for outputting as part of said code an index indicating said balancing factor; and said power correcting means is means for multiplying the acoustic signal sample sequence of that channel by said provided balancing factor.

58. The coding device of claim 57, wherein said power decision means is means whereby a power ratio k between said left and right channels is calculated, and when said ratio is equal to or greater than 1, said acoustic signal sample sequence of the channel of the smaller power is multiplied by $8=k^r$ as said balancing factor and when $0<k<1$, said acoustic signal sample sequence of the channel of the smaller power is multiplied by 1/g as said balancing factor, said r being a constant defined by $0<r<1$.

59. The coding device of claim 57, wherein said power decision means is means for: calculating a power ratio k between said left and right channels; deciding which of predetermined plural sub-regions said value k belongs to, said plural sub-regions being divided from a region over which said value k is made possible; and multiplying said acoustic signal sample sequence of the channel of the smaller power by that one of predetermined for respective sub-regions which corresponds to said decided sub-region, and providing a code indicating said decided sub-region as an index indicating said balancing factor.

60. A decoding device f or decoding a code coded by interleaving acoustic signal sample sequences of plural channels into a one-dimensional signal sequence under a certain rule, said decoding device comprising:

decoding means for decoding an input sequence into said one-dimensional signal sequence by a decoding method corresponding to a coding method utilizing the correlation between a number of samples from different channels of said plural channels in said one-dimensional signal sequence; and inverse interleave means for distributing said one-dimensional signal sample sequence to said plural channels by a procedure reverse to that of said certain rule, thereby obtaining acoustic signal sample sequences of said plural channels.

61. The decoding device of claim 60, further comprising:

power index decoding means for decoding an input power correction index to obtain a balancing factor; and power inverse correcting means for correcting said acoustic signal sample sequences of said plural channels by said balancing factor to increase a power difference between them, thereby obtaining decoded acoustic signal sample sequences of plural channels.

62. The decoding device of claim 60 or 61, wherein said decoding means comprises:

spectrum residue decoding means for decoding an input first quantization code to obtain a spectrum residue;

spectral envelope decoding means for decoding an input second quantization code to obtain a spectral envelope;

de-normalizing means for multiplying said spectrum residue and said spectral envelope to obtain frequency-domain coefficients; and orthogonal inverse transform means for performing an orthogonal inverse transformation of said frequency-domain coefficients to obtain said one-dimensional signal sample sequence in a time domain.

63. The decoding device of claim 62, wherein said spectral envelope decoding means comprises LPC analysis means for decoding said second quantization code to obtain LPC coefficients and spectral envelope calculating means for calculating said spectral envelope from said LPC coefficients.

64. The decoding device of claim 62, wherein said spectrum residue decoding means in said step (a-1) is vector decoding means.

65. The decoding device of claim 63, wherein said first quantization code includes first and second indexes and said spectrum residue decoding means comprises:

fine structure coefficient decoding means for decoding said first index to restore spectrum Fine structure coefficients;

residual-coefficient envelope decoding means for decoding said second index to obtain a residual-coefficient envelope; and de-normalizing means for multiplying said spectrum fine structure coefficients and said residual-coefficient envelope to obtain said spectrum residue.

66. The decoding device of claim 60 or 61, wherein said decoding means comprises:

decoding means for obtaining frequency-domain coefficients, by adaptive bit allocation decoding, from an input first quantization code indicating quantized frequency-domain coefficients and an input second quantization code indicating a quantized spectral envelope; and orthogonal inverse transform means for performing an orthogonal inverse transformation of said frequency-domain coefficients to obtain said one-dimensional signal sample sequence.

67. The decoding device of claim 60 or 61, wherein said decoding means comprises:

predictive coefficient decoding means for obtaining LPC coefficients by decoding an input first quantization code indicating quantized LPC coefficients;

spectral envelope estimating means for estimating a spectral envelope from said LPC coefficients;

adaptive bit allocation decoding means for obtaining a residual-coefficient spectrum by adaptive bit allocation decoding of an input second quantization code indicating a quantized residual-coefficient spectrum, through bit allocations based on said spectral envelope;

orthogonal inverse transform means for performing an orthogonal inverse transformation of said residual-coefficient spectrum to obtain an excitation signal sample sequence; and synthesis filter means for obtaining said one-dimensional signal sample sequence by processing said excitation signal sample sequence with a synthesis filter using said LPC coefficients as filter coefficients.

68. The decoding device of claim 60 or 61, wherein said decoding means comprises:

vector decoding means for obtaining a spectral residual by vector-decoding an input first vector quantization code indicating vector-quantized spectral residual;

a second vector decoding means for obtaining a spectral envelope by vector-decoding an input second vector quantization code indicating a vector-quantized spectral envelope;

inverse-normalization means for obtaining frequency-domain coefficients by multiplying said spectral residual and said spectral envelope for corresponding samples thereof; and orthogonal inverse transform means for performing an orthogonal inverse transformation of said frequency-domain coefficients to obtain said one-dimensional signal sample sequence.

69. The decoding device of claim 60 or 61, wherein said decoding means comprises:

decoding means for obtaining a quantized prediction error by decoding an input quantization code indicating said quantized prediction error;

adaptive prediction means for adaptively predicting the current sample value from the previous decoded sample; and adder means for adding said quantized prediction error to a predicted version of said sample value to obtain the current decoded sample value.

70. The decoding device of claim 60 or 61, wherein said decoding means comprises:

an adaptive codebook for generating an excitation vector of the current frame by extracting from an excitation vector of the previous frame a segment of a length designated by an input index indicating the segment length of said excitation vector; and synthesis filter means supplied with input LPC coefficients as filter coefficients, for processing said excitation vector of said current frame to obtain said one-dimensional signal sample sequence.

71. The decoding device of claim 62, further comprising means supplied with a set of said first and second quantization codes for each of predetermined plural frequency bands, for selecting and decoding the set of said quantization codes for a desired one of said plural frequency band to obtain frequency-domain coefficients of the selected frequency band.

72. The decoding device of claim 66, further comprising means supplied with a set of said first and second quantization codes for each of predetermined plural frequency bands, for selecting and decoding the set of said quantization codes for a desired one of said plural frequency band to obtain frequency-domain coefficients of the selected frequency band.

73. The decoding device of claim 68, further comprising means supplied with a set of said first and second quantization codes for each of predetermined plural frequency bands, for selecting and decoding the set of said quantization codes for a desired one of said plural frequency band to obtain frequency-domain coefficients of the selected frequency band.

74. The decoding device of claim 61, wherein said plural channels are two left and right channels, said decoded balancing factor is equal to or greater than 1, and said power inverse correction means is means whereby that one of said acoustic signal sample sequences of said left and right channels which is of the smaller power is divided by said balancing factor to obtain decoded acoustic signal sample sequences of said left and right channels.

* * * * *